US010702054B2

(12) United States Patent
Rudolph

(10) Patent No.: US 10,702,054 B2
(45) Date of Patent: Jul. 7, 2020

(54) SYSTEM, APPARATUS AND METHOD FOR DELIVERING FLUID TO AND FROM THE BOTTOM CENTER OF A FLOOR-OPERATION PAD ON A ROTARY-MOTION FLOORING MACHINE DURING OPERATION

(71) Applicant: Gary Rudolph, Esperance, NY (US)

(72) Inventor: Gary Rudolph, Esperance, NY (US)

( * ) Notice: Subject to any disclaimer, the term of this patent is extended or adjusted under 35 U.S.C. 154(b) by 289 days.

(21) Appl. No.: 15/594,636

(22) Filed: May 14, 2017

(65) Prior Publication Data

US 2017/0245721 A1 Aug. 31, 2017

(51) Int. Cl.

| | |
|---|---|
| ***A47L 11/00*** | (2006.01) |
| ***A46B 13/00*** | (2006.01) |
| ***B24B 7/18*** | (2006.01) |
| ***A47L 11/40*** | (2006.01) |
| ***A47L 11/16*** | (2006.01) |
| ***B24B 29/00*** | (2006.01) |
| ***B24B 57/02*** | (2006.01) |

(52) U.S. Cl.

CPC ..... *A46B 13/008* (2013.01); *A47L 11/161* (2013.01); *A47L 11/4038* (2013.01); *A47L 11/4088* (2013.01); *B24B 7/186* (2013.01); *B24B 29/005* (2013.01); *B24B 57/02* (2013.01)

(58) Field of Classification Search

None

See application file for complete search history.

(56) References Cited

U.S. PATENT DOCUMENTS

| | | | |
|---|---|---|---|
| 1,498,255 | A | 6/1924 | Winchester |
| 1,829,132 | A | 10/1931 | Finnell |
| 1,927,227 | A | 9/1933 | Woods |
| 2,541,812 | A | 2/1951 | Finnell |
| 2,600,233 | A | 6/1952 | Finnell |
| 3,418,672 | A | 12/1968 | Regan |

(Continued)

FOREIGN PATENT DOCUMENTS

GB 1105705 A 3/1968

OTHER PUBLICATIONS

International Search Report dated Aug. 21, 2018 for counterpart application PCT/US18/31724.

(Continued)

*Primary Examiner* — Michael E Barr
*Assistant Examiner* — Jason P Riggleman
(74) *Attorney, Agent, or Firm* — Jay R. Yablon

(57) ABSTRACT

A system and related apparatus and method for delivering fluid to and from a bottom center of a floor-operation pad on a rotary-motion flooring machine while the pad is rotationally operating on a horizontal underfoot surface, the system comprising a fluid-delivery hub comprising: a plurality of fluid entry openings disposed on an outside circumferential surface thereof; an equal plurality of fluid flow channels commencing at the fluid entry openings, angling downward and inward from the fluid entry openings toward a center of the fluid-delivery hub, and terminating at an equal plurality of fluid exit openings proximate a bottom center of the fluid-delivery hub; and a floor-operation interface at a bottom of the fluid-delivery hub configured to directly or indirectly attach a floor-operation pad thereto, for operating on a floor.

40 Claims, 12 Drawing Sheets

(56) References Cited

U.S. PATENT DOCUMENTS

| | | | | |
|---|---|---|---|---|
| 5,735,959 | A | 4/1998 | Kubo et al. | |
| 5,827,368 | A | 10/1998 | Stango | |
| 6,620,242 | B1 | 9/2003 | Behr et al. | |
| 7,530,135 | B2 | 5/2009 | Benedict | |
| 8,555,450 | B1 | 10/2013 | Sabol et al. | |
| 2007/0082136 | A1 | 4/2007 | Biernot | |
| 2017/0311769 | A1* | 11/2017 | Studebaker | A47L 11/293 |

OTHER PUBLICATIONS

Written Opinion of the International Searching Authority dated Aug. 21, 2018 for counterpart application PCT/US18/31724.

* cited by examiner

SYSTEM, APPARATUS AND METHOD FOR DELIVERING FLUID TO AND FROM THE BOTTOM CENTER OF A FLOOR-OPERATION PAD ON A ROTARY-MOTION FLOORING MACHINE DURING OPERATION

BACKGROUND OF THE INVENTION

Rotary devices such as floor buffers used in cleaning and polishing and sanding, and for abrading of floors and other flat horizontal bottom underfoot surfaces, experience problems and are ineffective when used to apply fluids such as cleaning solutions, water, finishes and wood stain to floors and other flat horizontal bottom surfaces. Placing the fluid on the floor surface and then operating the buffer in the puddle of fluid does not allow the fluid to effectively get under the pad of the rotating device and results in slinging of the fluid. This is both messy and results in uneven application.

An often-employed technique is to use a solution tank with a valve to dump fluid onto the top of a rotating drive pad. The drive pad may have a series of holes that allow the fluid to disperse download into a porous pad which then allows the fluid to reach the bottom of the pad and contact the floor surface. However, the spinning action of the pad forces the fluid to disperse unevenly over the top of the drive pad. As a result some fluid splashes over the top sides of the drive pad, at the junction of the drive pad with the floor pad. Fluid is thrown from the top of the spinning pad, from the junction of the pad driver and pad, and from the sides of the pad. Only smaller amounts of fluid finally seep through the bottom of the floor pad to the contact area on the floor. This is messy, with the fluid hitting undesirable surfaces such as walls, baseboards and other objects located at heights just above the floor. This slinging of fluid also results in an uneven application of the fluid, with this random spotting and uneven application producing, for example, spots with are too light or too dark.

This invention disclosed here, which overcomes the foregoing problems, relates generally to the field of rotary-motion sanders, polishers, buffers, carpet cleaners, etc., and specifically to rotary motion of hand operated devices, e.g., buffers. Specifically, this invention turns these rotary-motion devices into center injection fluid-feed systems. Utilizing a coaxial rotary joint center-mounted fluid well ring that orbits around a center-mounted hub, fluid is passed from the outside of the ring through the center hub via fluid flow channels from the outside circumference to the center of hub. Regarding air itself to be within the definition of a "fluid" as used in this disclosure, and because this configuration can operated with fluid flowing toward or away from the bottom center of the hub, this configuration also can employ an applied vacuum to collect air and dust from under the bottom center of the hub, which makes this invention also useful as a vacuum for cleaner sanding.

SUMMARY OF THE INVENTION

Disclosed herein is a system and related apparatus and method for delivering fluid to and from a bottom center of a floor-operation pad on a rotary-motion flooring machine while the pad is rotationally operating on a horizontal underfoot surface, the system comprising a fluid-delivery hub comprising: a plurality of fluid entry openings disposed on an outside circumferential surface thereof; an equal plurality of fluid flow channels commencing at the fluid entry openings, angling downward and inward from the fluid entry openings toward a center of the fluid-delivery hub, and terminating at an equal plurality of fluid exit openings proximate a bottom center of the fluid-delivery hub; and a floor-operation interface at a bottom of the fluid-delivery hub configured to directly or indirectly attach a floor-operation pad thereto, for operating on a floor.

The goal of this invention is to use a rotary tool/buffer to rub wood floor stain, floor finish, floor-cleaning products, water or other floor chemical fluids onto a surface such as wood or other floor surfaces. It needs to evenly distribute the fluid and not cause slinging outward of the fluid. To do this the fluid must be allowed to enter the center or near-center of the contact pad/abrasive, through a non-rotating flow channel. This technique reduces the effect of centrifugal force allowing the assist of gravity in the direction of flow. When fluid, which includes air, is flowed in the opposite direction, the device also operates as a clean vacuum for sanding applications.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) summarized below.

FIG. 2 is locked onto the fluid-delivery hub of FIG. 1 using the locking ring for FIG. 3.

FIGS. 11 and 12 are drawn to the same relative scale, so that a visual projection of vertical lines from one to the other serves to project the views into one another.

FIGS. 13 and 14 are drawn to the same relative scale set by the floor-operation pad of FIG. 13, so that a visual projection of vertical lines from one to the other serves to map the two views of the floor-operation pad into one another.

DETAILED DESCRIPTION

Figure 1A:
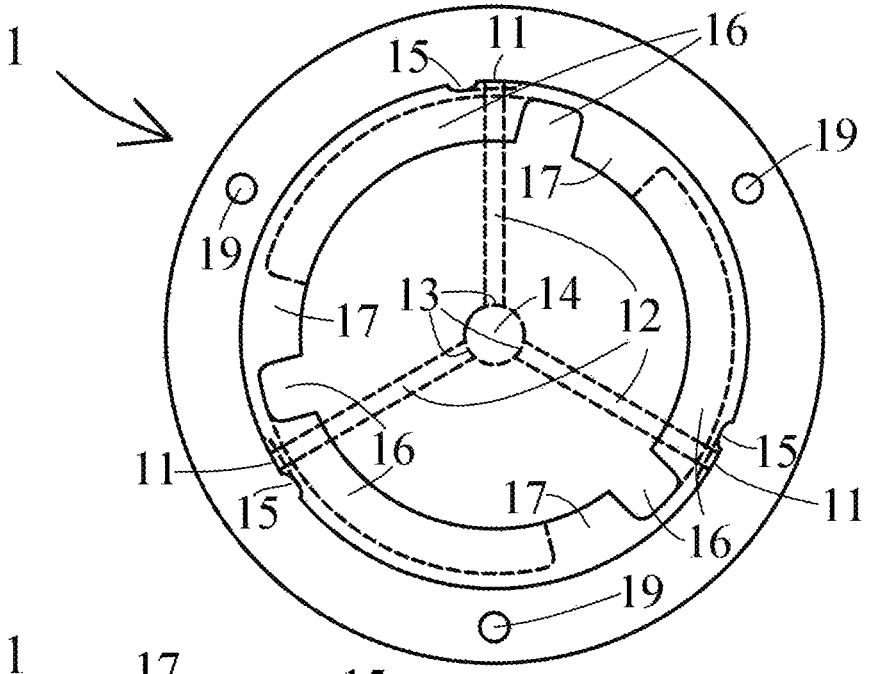
FIGS. 1A, 1B and 1C respectively illustrate top, side and bottom plan views of a fluid-delivery hub in accordance with a preferred embodiment of the invention. These are all drawn to the same relative scale, so that a visual projection of vertical lines from one to the other serves to map the views into one another.
Figure 1B:
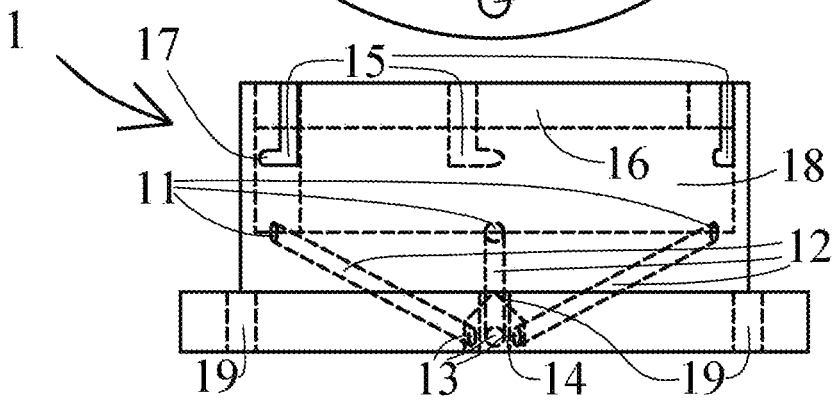
Figure 1C:
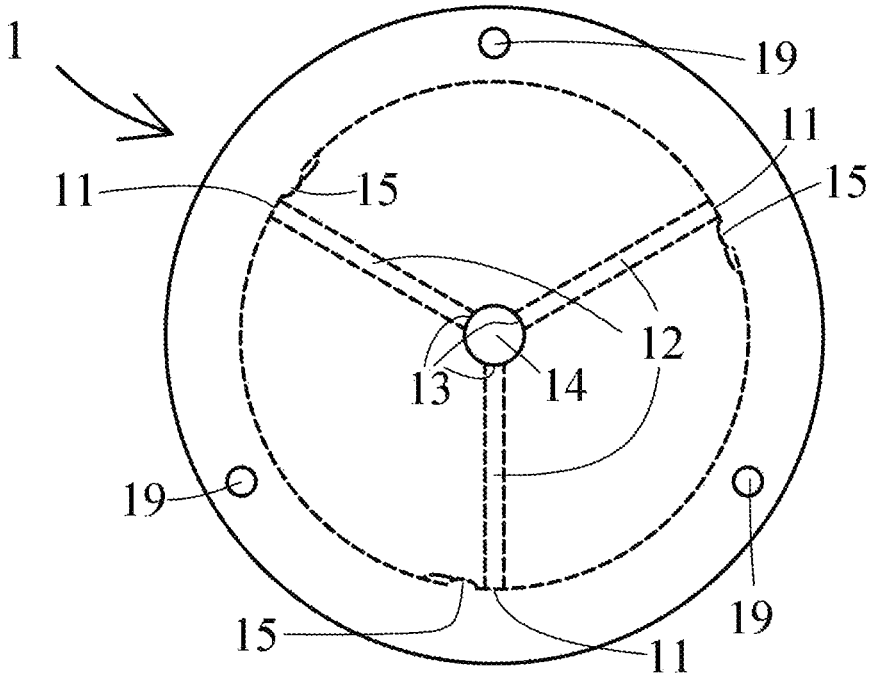
Figure 2A:
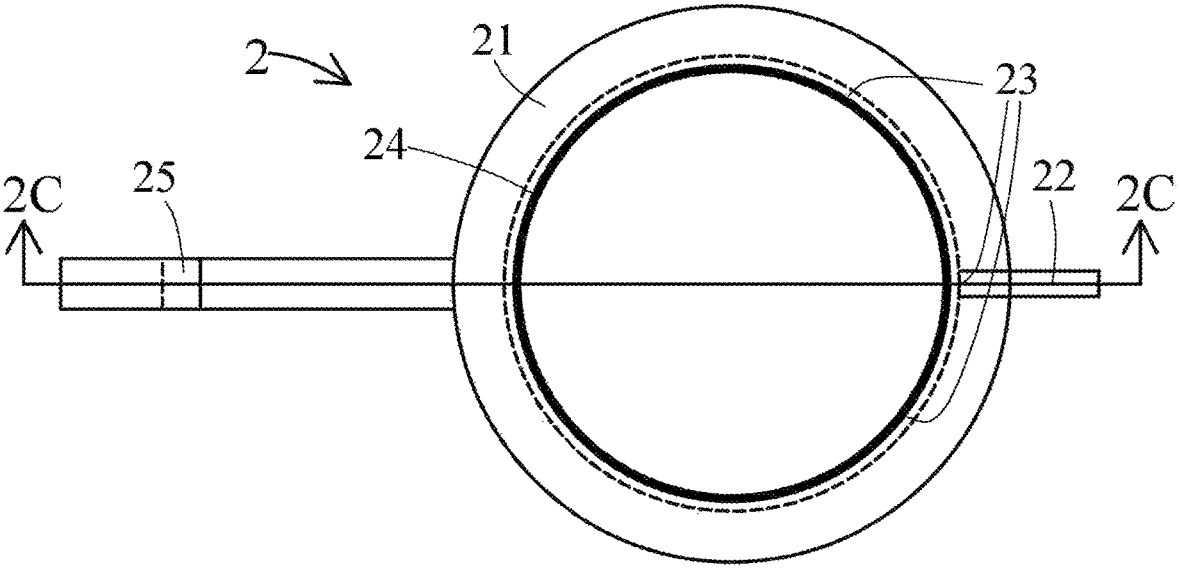
FIGS. 2A, 2B and 2C respectively illustrate top and side plan views, and then a side cross-sectional view along the lines 2C-2C of FIG. 2A, of a fluid well ring in accordance with a preferred embodiment of the invention, mating with the fluid-delivery hub in a configuration enabling rotation of the fluid-delivery hub relative to the fluid well ring. These likewise are all drawn to the same relative scale, so that a visual projection of vertical lines from one to the other serves to map the views into one another.
Figure 2B:
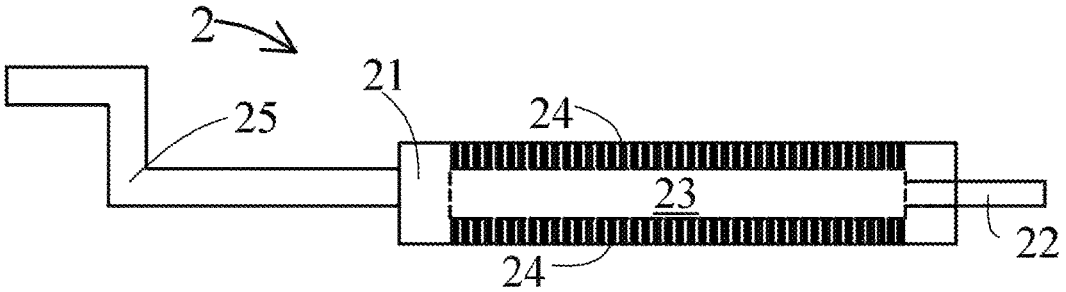
Figure 2C:
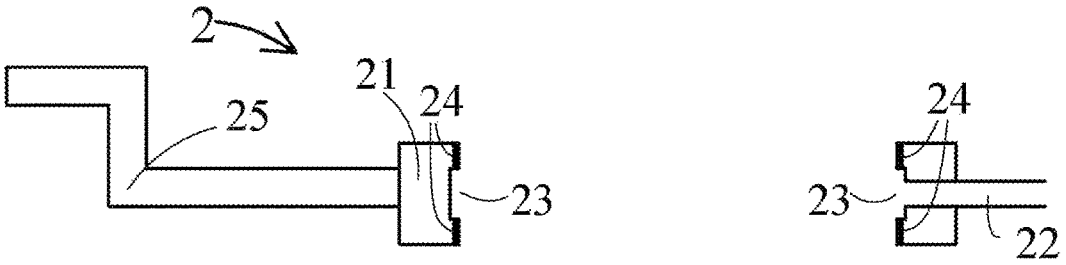
Figure 3A:
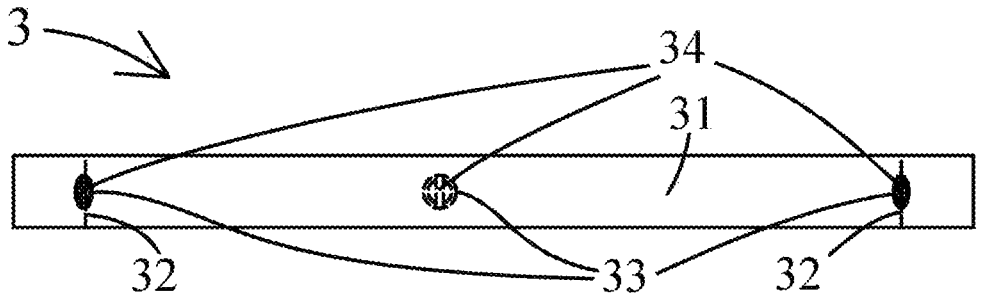
FIGS. 3A and 3B respectively illustrate top and side plan views of a locking ring in accordance with a preferred embodiment of the invention, for mating with and locking onto the fluid-delivery hub in a configuration which secures the fluid well ring to the fluid-delivery hub. These likewise are drawn to the same relative scale, so that a visual projection of vertical lines from one to the other serves to map the views into one another.
Figure 3B:
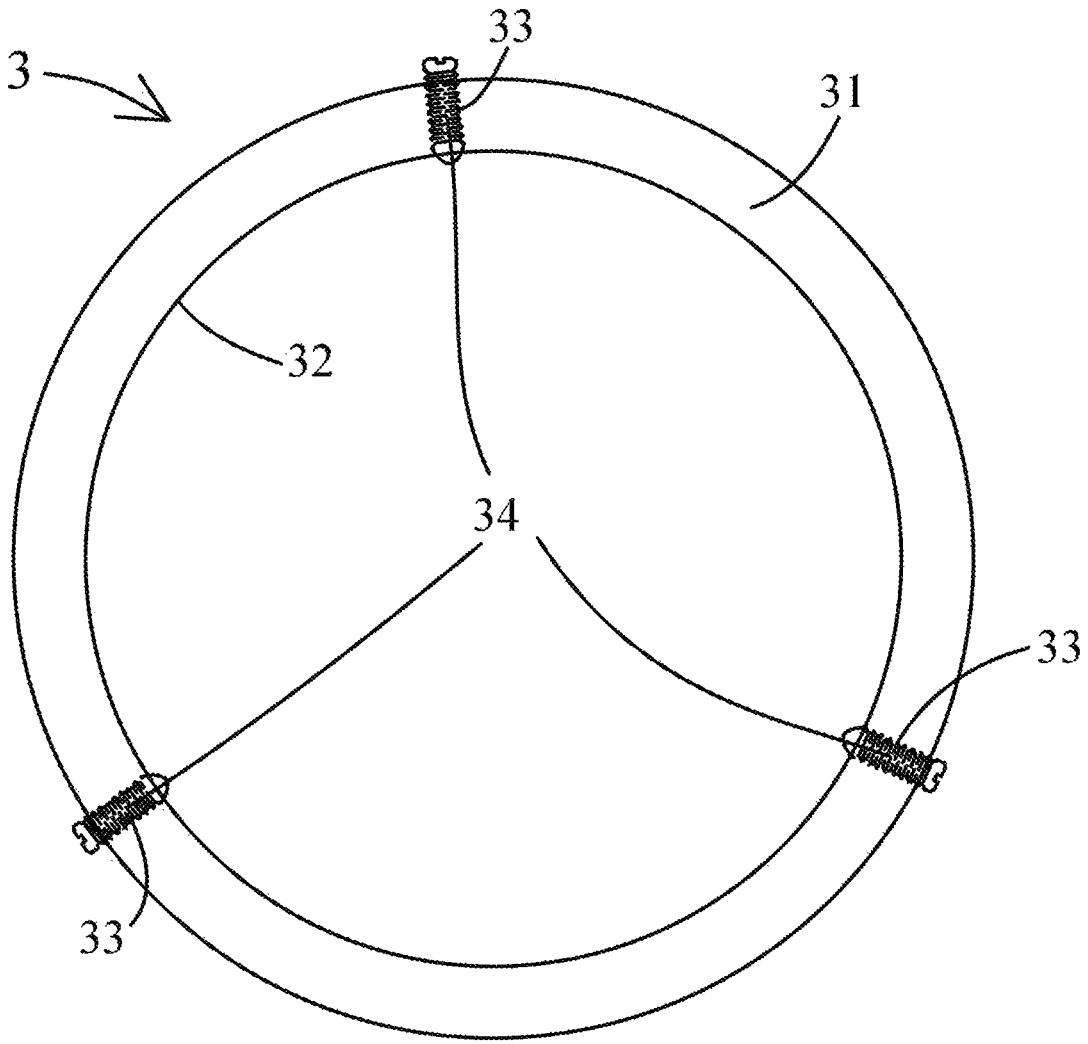

The primary assembly used to deliver fluid to the bottom center of a rotating applicator pad for even fluid application without flinging or spotting comprises three distinct primary components which assemble together in a two-step primary assembly method which will now be detailed by FIGS. 1 through 8. FIGS. 1, 2 and 3 illustrate these three primary components. FIGS. 1A, 1B and 1C respectively illustrate top, side and bottom plan views of a fluid-delivery hub 1, which is the first such component. FIGS. 2A and 2B respectively illustrate top and side plan views, and FIG. 2C a side cross section along the line 2C-2C of FIG. 2A, of a fluid well ring 2. This is the second such component, configured for mating with the fluid-delivery hub 1 in a configuration enabling rotation of the fluid-delivery hub 1 relative to the fluid well ring 2. FIGS. 3A and 3B respectively illustrate top and side plan views of a locking ring 3 which is the third such component, for mating with and locking onto the fluid-delivery hub 1 in a configuration which secures the fluid well ring 2 to the fluid-delivery hub 1. FIGS. 4 through 8 then illustrate the assembly of the fluid-delivery hub 1, the fluid well ring 2 and the locking ring 3 together into their overall operative configuration.

We begin with FIGS. 1A, 1B and 1C respectively showing top, side and bottom plan views of the fluid-delivery hub 1. The hub 1 is an article of manufacture preferably fabricated from steel, metal, aluminum, or a similar hard durable substance that will not deteriorate in response to repeated exposure to fluids. In these FIG. 1, the broken lines illustrate lines which are hidden, and the solid lines illustrate lines which are visible, from the particular view. It is most important to appreciate at the outset that the fluid-delivery hub 1 contains a plurality of fluid entry openings 11 disposed on an outside circumferential surface of the hub 1 as shown. These are entry ports to an equal plurality of fluid flow channels 12 commencing at the fluid entry openings 11, angled downward going inward from the outside circumference to the inner center of the hub 1, and terminating at an equal plurality of fluid exit openings 13 all meeting up in and disposed on a fluid dispensing opening 14 centered at the very bottom of the fluid-delivery hub 1 as shown. It will be appreciated that if fluid could be made to enter the fluid flow channels 12 at their respective fluid entry openings 11 (as it is and as will soon be shown), then the fluid would flow naturally down under the influence of gravity to emerge through the fluid exit openings 13 and out the fluid dispensing opening 14.

In FIG. 1, the fluid flow channels 12 are illustrated to be angled at approximately 25 degrees, but this is for example and not limiting. This descent angle from the outside circumference to the inner bottom center may be a small as 5 or 10 degrees and a much as 45 or even 60 degrees. It is required only that the fluid exit openings 13 and the fluid dispensing opening 14 be substantially centered at the bottom of the hub 1. It will be appreciated that if the fluid-delivery hub 1 was to be rotating because it was attached to a rotary-motion flooring machine 140 (see FIG. 14) such as a floor buffer or a sander (as it is and as will also soon be shown), then the centrifugal force caused by such rotation would eventually overcome the downward gravitational force and stop the fluid from flowing inward and downward if the rotation was to be rapid enough. Keeping in mind that rotary-motion flooring machines 140 typically operate at frequencies of 175 RPM (i.e., about three revolutions per second), it has been found in experimental testing that the illustrated 25 degree angling readily maintains the inward and downward flow and that this flow is not overcome by the centrifugal action of the rotation. And it has also been found that if needed, positive pressure pumps can further counteract the centrifugal forces and ensure that the fluid flow remains downward and inward. The vertical height of the fluid entry openings 11 on the outside circumference of the hub 1 is geometrically-determined by this descent angle together with the radius of the hub 11, but there is no particular requirement for the height of the fluid entry openings 11 other than ensuring that fluid entering these openings 11 will flow down to the dispensing opening 14 while the hub 1 rotating at typical operational frequencies.

Although there are three (3) fluid entry openings 11 and corresponding fluid flow channels 12 and fluid exit openings 13 in the plurality illustrated in FIGS. 1A, 1B and 1C, this is for example and is in no way limiting. There may be as few as two fluid flow channels 12 and their respective entry 11 and exit 13 points, and as many as a dozen or more, although there is no apparent practical gain to having a larger number than three. It will also be seen that these three fluid flow channels 12 and their entries 11 and exits 13 are relatively oriented at substantially equilateral angles from one another relative to the center origin of the hub 1, and so are oriented 120 degrees apart when viewed from above or below the hub 1. Such equilateral angular relative orientations optimize a uniform flow of fluid. Thus, for example not limitation, if one was to employ four (4) fluid flow channels 12 and entries 11 and exits 13 the equilateral angles would preferably be 90 degrees; for five (5) these would be 72 degrees apart, and for N these would be N/360 degrees apart.

Finally, while all three of the illustrated fluid exit openings 13 are shown to terminate in a single fluid dispensing opening 14, having such a single fluid dispensing opening 14 is optional not required. The fluid exit openings 13 may each terminate individually proximate the bottom center of the hub 1 on individual, one-by-one bases. The broad requirement is to have a plurality of fluid flow channels 12 commencing at the fluid entry openings 11, angling downward and inward from the fluid entry openings 11 toward the center of the fluid-delivery hub 1, and terminating at an equal plurality of fluid exit openings 13 proximate the bottom center of the fluid-delivery hub 1. Having these fluid exit openings 13 also terminate in a single fluid dispensing opening 14 is entirely optional.

In view of all the foregoing, three objectives need to be accomplished to deliver fluids to the center of a floor applicator using the fluid-delivery hub 1: First, the fluid-delivery hub 1 needs to be attached to a rotary-motion flooring machine 140 such as a floor buffer so that the machine can impart the operative rotation to the hub 1. Second, fluid needs to be delivered to the fluid entry openings 11 while the fluid-delivery hub 1 is being rotationally driven. Third, a fluid applicator with a hole proximate its center needs to be attached at the very bottom of the fluid-delivery hub 1, so that the fluid applicator is also rotating and so that when the fluid emerges through the fluid dispensing opening 14 it will naturally be dispensed through the center of the rotating applicator.

As to the first objective, it will be seen that the top region of the fluid-delivery hub 1 contains a rotary device mating interface 16 and rotational drive contacts 17. In essence, as will be later discussed, these illustrative elements 16 and 17 comprise a standard rotation-driving mating interface by which a separate buffer or sander or other floor-operation pad 110 (to first be introduced in FIG. 11) is mated to a rotary-motion flooring machine 140 such as will later be illustrated by FIG. 14. As to the third objective, the bottom of the fluid-delivery hub 1 has a floor-operation interface 19 comprising, for example not limitation, a plurality of pad driver mating holes (in this non-limiting illustration, three) via which the floor-operation pad 110 may be directly or indirectly attached to the bottom of the hub 1 using, e.g., screws or bolts or the like, so as to rotate along with the hub. As to the second objective, which is key to the invention, we turn to FIG. 2 to show how the fluid is delivered to the fluid entry openings 11 while the fluid-delivery hub 1 is being rotationally driven.

FIGS. 2A and 2B respectively illustrate top and side plan views of a fluid well ring 2. This ring 2 comprises a ring body 21, which like the hub 1 is also preferably fabricated from steel, metal, aluminum, or a similar hard durable substance that will not deteriorate under repeated exposure to fluids. Running radially through the ring body 21 is a fluid introduction port 22 commencing outside the ring body 21 and terminating in a fluid well 23 running over the inside circumference of the ring body 21, all as shown. From the side view of FIG. 2B, it is seen that the inside circumference of fluid well 23 is bounded both from above and from below by a pair of fluid-sealing rings 24 (e.g., O-rings) also running over the entire inside circumference of the ring body 21. These sealing rings 24 are hidden in this side plan view and so are shown in wide broken lines. These fluid-sealing rings 24 are preferably fabricated from rubber, silicon, or equivalent materials conventionally used in the art to provide a fluid barrier that bars the passage of fluid through the barrier.

Importantly, the linear dimension of the inside circumference of the sealing rings 24 is chosen to be substantially equal to the linear dimension of the outside circumference of the fluid-delivery hub 1 where the fluid entry openings 11 are situated. This dimensional concurrence is best seen by referring to the side cross section cutaway view of FIG. 2C, as taken along the lines 2C-2C of FIG. 2A, and also by referring to FIG. 4, which contains a view that is a hybrid of FIGS. 2B and 2C. From the cutaway cross section of FIG. 2C, all that is seen are the outer horizontal extremities of the ring body 21, the fluid well 23 and the fluid-sealing rings 24. Then in FIG. 4, the border lines 42 highlight precisely how the inside diameters of the sealing rings 24 align so that these rings 24 can be snugly fitted and securely sealed over the outside diameter of the fluid-delivery hub 1 where the fluid entry openings 11 are situated.

When this fitting has been completed as then shown in FIG. 5, the fluid well 23 is now situated all around the circumference of the fluid-delivery hub 1 over the fluid entry openings 11, while the sealing rings 24 are situated above and below the fluid well 23 to prevent fluid in the well 23 from escaping in a vertical direction either up or down. So when the configuration of FIG. 5 has been assembled, as also seen from FIG. 6 which is a top view of FIG. 5, fluid 51 which flows into the fluid well 23 from outside the fluid well ring 2 via the fluid introduction port 22 can only move into the fluid flow channels 12. And once fluid 51 enters the fluid flow channels 12, the 51 fluid will be naturally routed by gravity toward the fluid exit openings 13 and out the fluid dispensing opening 14, which realizes the central goal of the invention to provide a center injection fluid-feed system.

Figure 4:
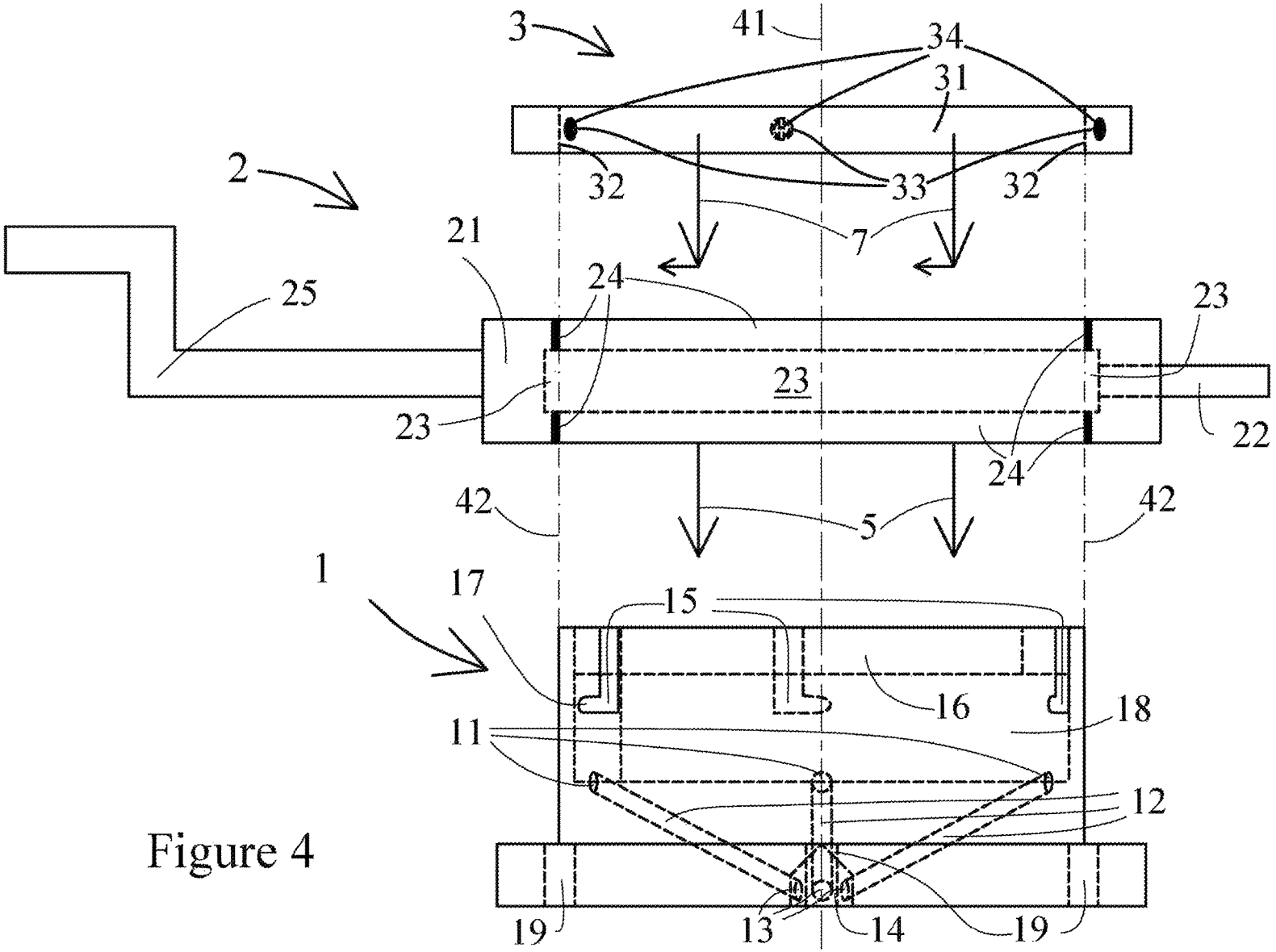
FIG. 4 is an exploded side plan view illustrating an overview of a two-step primary assembly method by which the fluid well ring if
Figure 5:
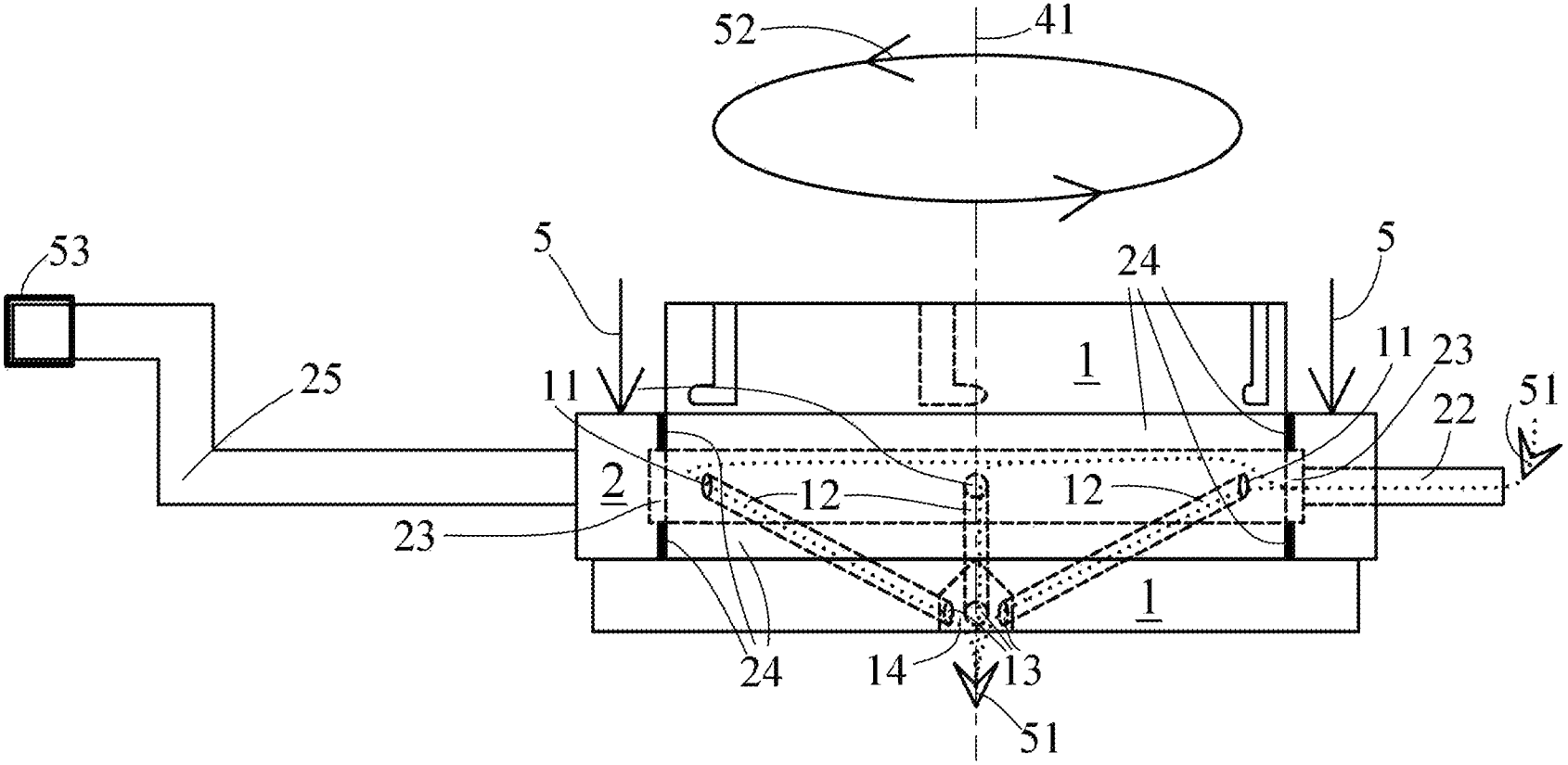
FIG. 5 is a side plan view illustrating the fluid well ring of FIG. 2 after it has been mated onto the fluid-delivery hub of FIG. 1 in a configuration enabling relative rotation between the two, in accordance with the first step of the two-step primary assembly method.

So what we have now shown is that the fluid well ring 2 is configured to fit over the perimeter of the fluid-delivery hub 1 such that when the ring 2 is in fact fitted onto the hub 1 in accordance with the first of the two primary method steps illustrated by the fitting arrows 5 in FIG. 4, the resulting configuration of FIG. 5 situates and seals 24 the fluid well 23 all about the fluid entry openings 11 to deliver fluid 51 to the bottom center of the hub 1, precisely as desired. But the other important feature of this configuration is that this fitting achieved by the operation 5 also enables the fluid-delivery hub 1 to rotate relative to the fluid well ring 2, as we shall now elaborate.

Figure 6:
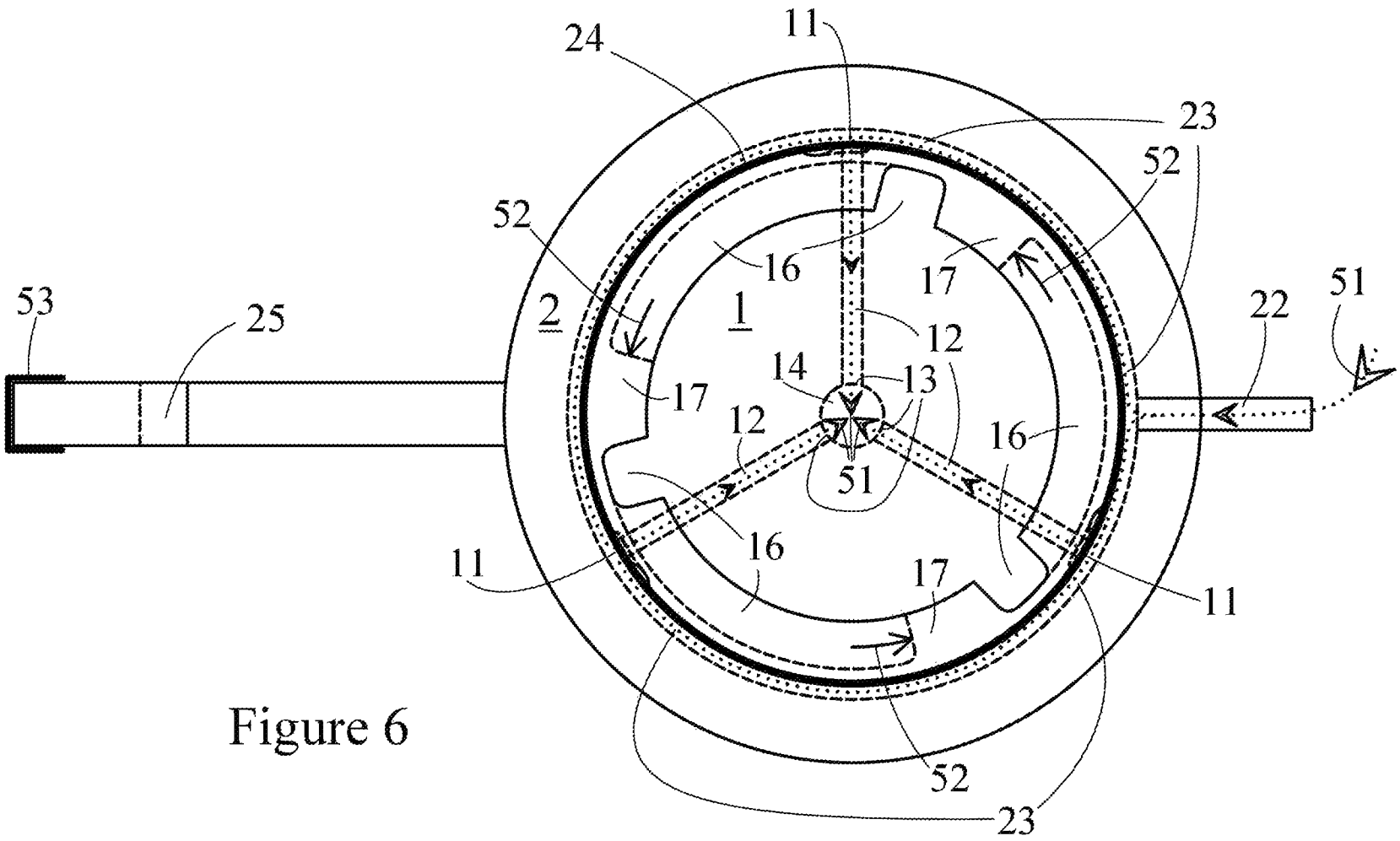
FIG. 6 is a top plan view of the configuration of FIG. 5.

Starting with FIG. 2, and also referring to FIGS. 5 and 6 with the former being a side plan view and the latter a top plan view, we see that the fluid well ring 2 further comprises attached thereto, a fluid ring fixing member 25 which may be as simple as a solid durable arm permanently attached thereto. It will then be appreciated that if one was to secure the fluid ring fixing member 25 to a fixed location designated by 53 in FIGS. 5 and 6 to prevent the fluid well ring 2 from having any rotation about a rotational axis illustrated by the centerline 41 of FIG. 5, then if the fluid-delivery hub 1 is nevertheless rotated about the same axis 41, there will now be a relative rotation between the fluid-delivery hub 1 and the fluid well ring 2. Specifically, the fluid well ring 2 will not rotate at all, but the fluid-delivery hub 1 will rotate, which means that the fluid-delivery hub 1 will rotate while the sealing rings 24 remain in contact with the fluid-delivery hub 1 but, being part of the fluid well ring 2, do not rotate.

So the fluid-sealing rings 24 must have proper material characteristics to provide a good fluidic seal with the circumferential perimeter of the hub 1, while also having sufficient lubricity to maintain the seal during this rotation. There are many rubber, silicon and equivalent rings known or which may become known in the art which can provide a good fluidic seal between two relatively-rotating components, and any rings which are suitable for this purpose are regarded to be within the scope of this disclosure and the associated claims when such rings are employed as the fluid-sealing rings 24 of this invention.

Figure 14:
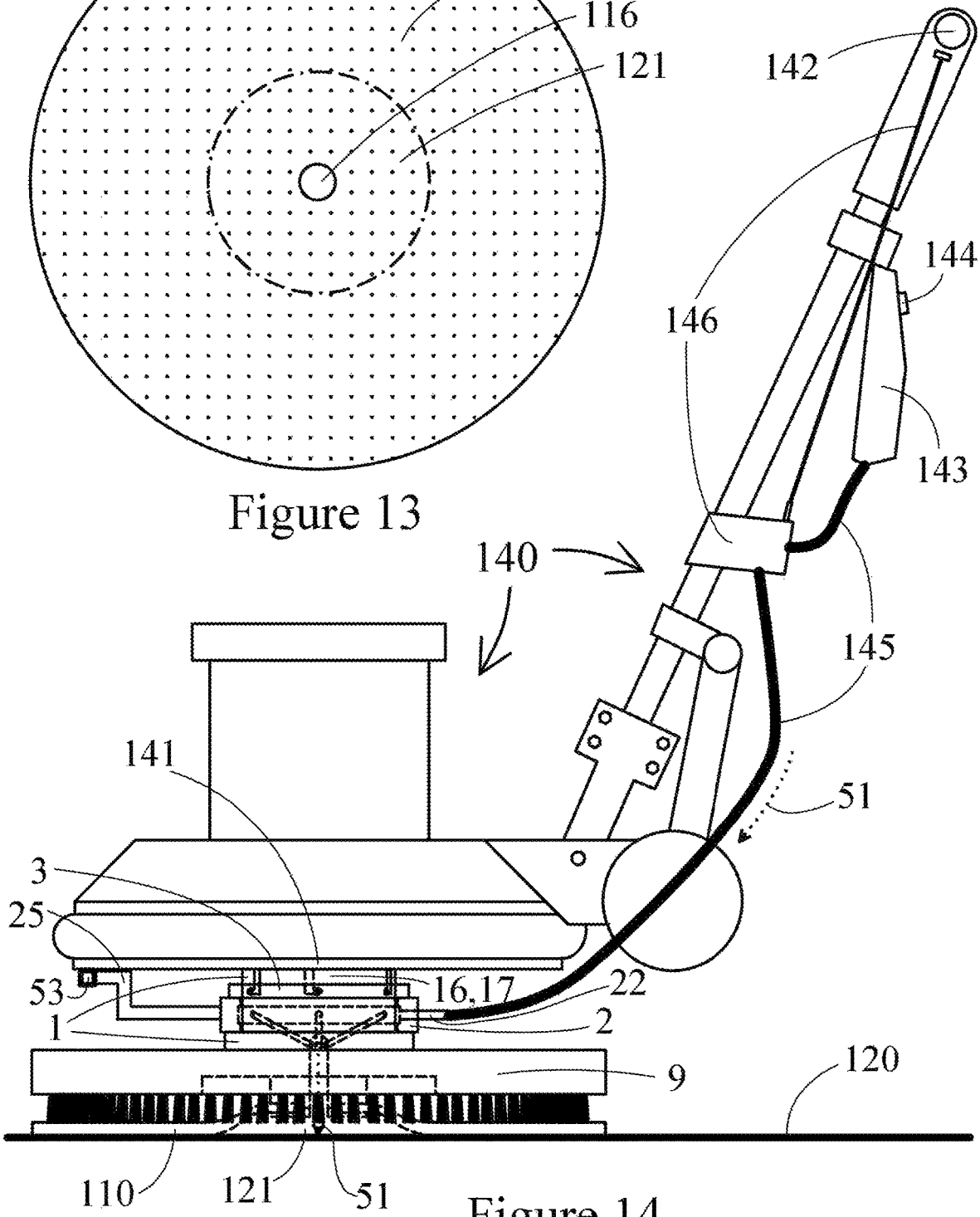
FIG. 14 illustrates a side plan view of the entire working assembly of FIG. 11 mounted to a rotary-motion flooring machine, thereby configured to operate on, and operating on, a floor.

So to use the configuration of FIGS. 5 and 6 to dispense fluid from the bottom center of the hub 1, the fixed location is preferably established by a fluid ring fixing restraint 53 which is fixed to a convenient non-rotating location on the rotary-motion flooring machine 140, e.g., buffer, sander, and the like, as will later be illustrated by FIG. 14. The preferred location for this would be on the underside of the rotary-motion flooring machine 140 as seen in FIG. 14, but this is for example not limitation. Likewise, the shape illustrated for the ring fixing member 25 is exemplary, not limiting. Generally, this ring fixing member 25 will be shaped in whatever manner is most convenient to fix the fluid well ring 2 to some non-rotating location on the rotary-motion flooring machine 140 to bar that ring 2 from rotating.

Thus, when the hub 1 and ring 2 configuration of FIGS. 5 and 6 is mounted to the rotary-motion flooring machine 140 via the device mating interface 16, and when the machine 140 imparts rotation to the hub 1 by pressing against the rotational drive contacts 17 with a rotational driving force best illustrated by the placement of the arrows 52 in FIG. 6, and when the fluid ring fixing member 25 e.g., armature is secured by the fluid ring fixing restraint 53 to a non-rotating part e.g. the underside of the rotary-motion flooring machine 140, and finally when fluid 51 is introduced into the fluid introduction port 22, this fluid 51 will flow through the flow path illustrated by the dotted lines in FIG. 6, and will end up being dispensed thorough the fluid dispensing opening 14 centered at the very bottom of the fluid-delivery hub 1, which is precisely the goal of the invention.

So, when a floor-operation tool or tools are additionally attached to the bottom of the hub 1 via the floor-operation interface 19, and so long as the floor-operation tool or tools have either a cutout or a permeable material at their center (s), the fluids 51 so-dispensed will be evenly applied to the floor or other horizontal ground surface, without the undesirable slinging discussed earlier that occurs with prior art approaches.

Now, although FIGS. 1 and 2 illustrate the fluid-delivery hub 1 and the fluid well ring 2 configured such that the fluid well 23 is fabricated to be part of the fluid well ring 2, it is to be understood that this is exemplary and not limiting. Referring to FIG. 5, what is important is that when the hub 1 and the ring 2 are assembled together in the configuration of FIGS. 5 and 6, the combined assembly results in there being a sealed fluid well 23 which is bounded at its horizontal extremities by the hub 1 inside toward the centerline 41 and by the ring 2 outside away from the centerline 41, and bounded at its upper and lower vertical extremities by the two fluid-sealing rings 24. Whether the space that will become the fluid well 23 is etched into the fluid-delivery hub 1 or into the fluid well ring 2 or into some combination of both is immaterial so long as this fluid well 23 arises about the fluid entry openings 11 once the ring 2 has been mated over the hub 1. Likewise, whether the two sealing rings 24 are affixed to the hub 1 or to the ring 2 or one sealing ring 24 is affixed to each of 1 and 2 is also immaterial so long as the fluid well 23 maintains a proper fluidic seal about the fluid well 23 once the fluid well ring 2 has been mated over the hub 1.

With the foregoing, we have now summarized the central points of the way in which this invention solves the problems posed by the prior art. However, it is also desirable to lock together the hub 1 and ring 2 configuration of FIGS. 5 and 6 so that the hub 1 and ring 2 are secured to one another while their relative rotation is being driven and while fluids 51 are being delivered. This is achieved by the locking ring 3 of FIG. 3, the configuration and operation of which will now be discussed.

FIGS. 3A and 3B illustrate a locking ring 3 from top and side plan views respectively. This locking ring 3 comprises a locking-ring body 31 with an inside circumference 32 thereof fabricated to mate with and fit snugly over the outside circumference of the fluid-delivery hub 1 on the surface containing the fluid entry openings 11, see the projection lines 42 in FIG. 4. That is, the locking-ring body 31, like the fluid well ring 2, has an inside circumference thereof substantially the same as an outside circumference of the fluid-delivery hub 1 proximate where the fluid entry openings 11 are disposed.

Passing through the locking-ring body 31 parallel to the radial direction are a plurality of locking-ring apertures 33 with an equal plurality of set screws or equivalent providing inward protrusions 34 which act as locks in the manner to now be elaborated. In FIG. 3 three (3) such apertures 33 and inward protrusions 34 are illustrated, but this is illustrative, not limiting. There may be as few as two (2) and as many as a dozen or more, but the three (3) which are illustrated are optimum for simple yet effective locking for reasons that will shortly become apparent. Additionally, it is preferred though not required that these apertures 33 and inward protrusions 34 be substantially equidistant from one another along the ring 3 circumference, which is also optimum for simple yet effective locking.

Turning to FIG. 4, after the fluid well ring 2 has been fitted 5 over the fluid-delivery hub 1 to yield the configuration of FIG. 5, the next step is to fit the inside circumference 32 of the locking ring 3 over the outside circumferential surface of the fluid-delivery hub 1 containing the fluid entry openings 11, then rotate the locking ring 3 over a small angle about the centerline 41 to lock the locking ring 3 in place, on and relative to the hub 1. Specifically, not yet discussed, FIG. 1 also illustrates a plurality of locking indentations 15 upon the outside circumferential surface of the fluid-delivery hub 1 which contains the fluid entry openings 11. From the side view FIG. 1B it is seen that these locking indentations 15 run vertically down from the top of the hub 1, then make a 90 degree turn toward the horizontal, forming a parity-inverted "L." The number of inward protrusions 34 as well as the circumferential placement of these inward protrusions 34 is fabricated to correspond on a one-to-one basis with the number and placement of locking indentations 15, so that these mate together.

Figure 7:
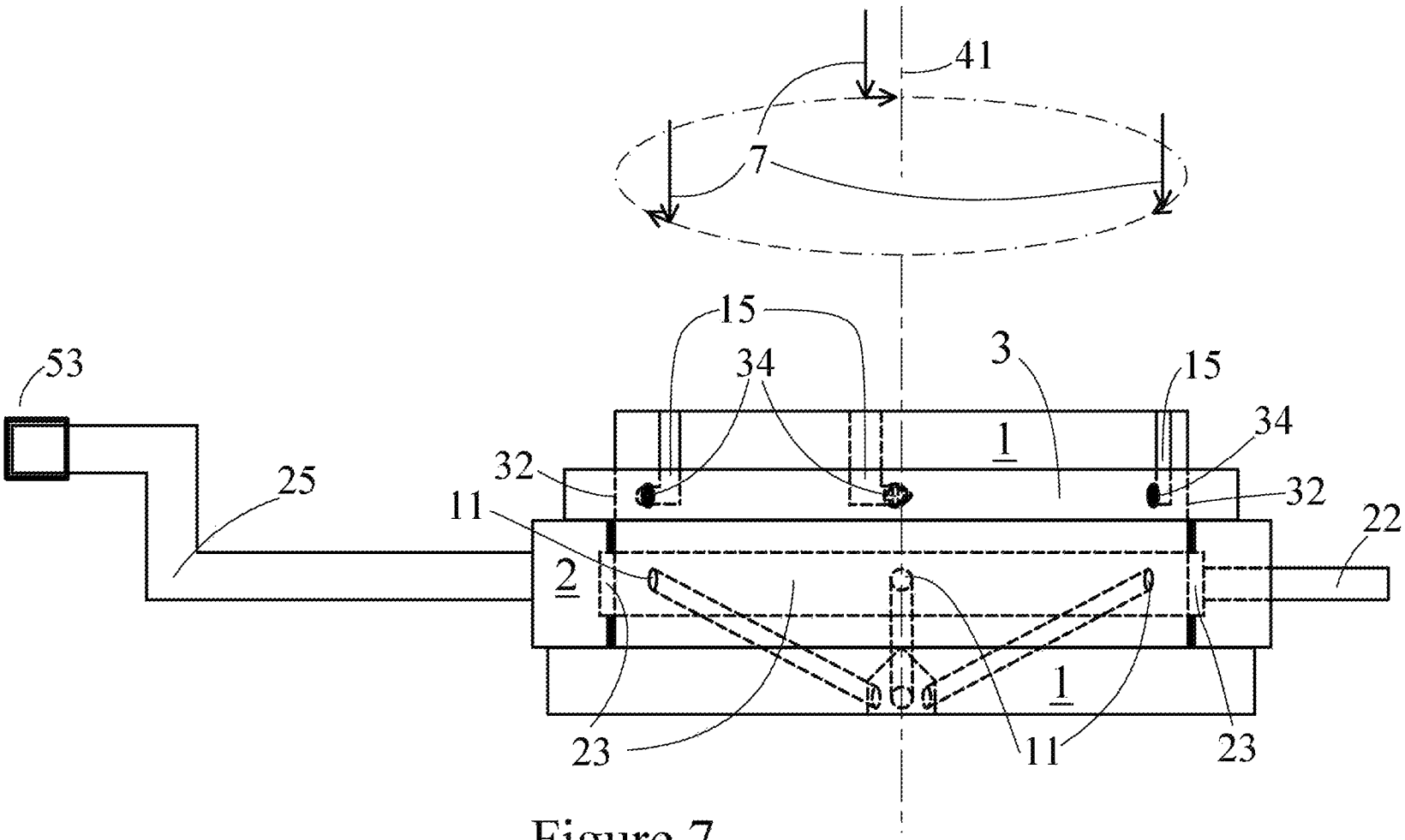
FIG. 7 is a side plan view illustrating the locking ring of FIG. 3 after it has been mated with and locked onto the fluid-delivery hub of FIG. 1 in a configuration securing the fluid well ring of FIG. 2 to the fluid-delivery hub.
Figure 8:
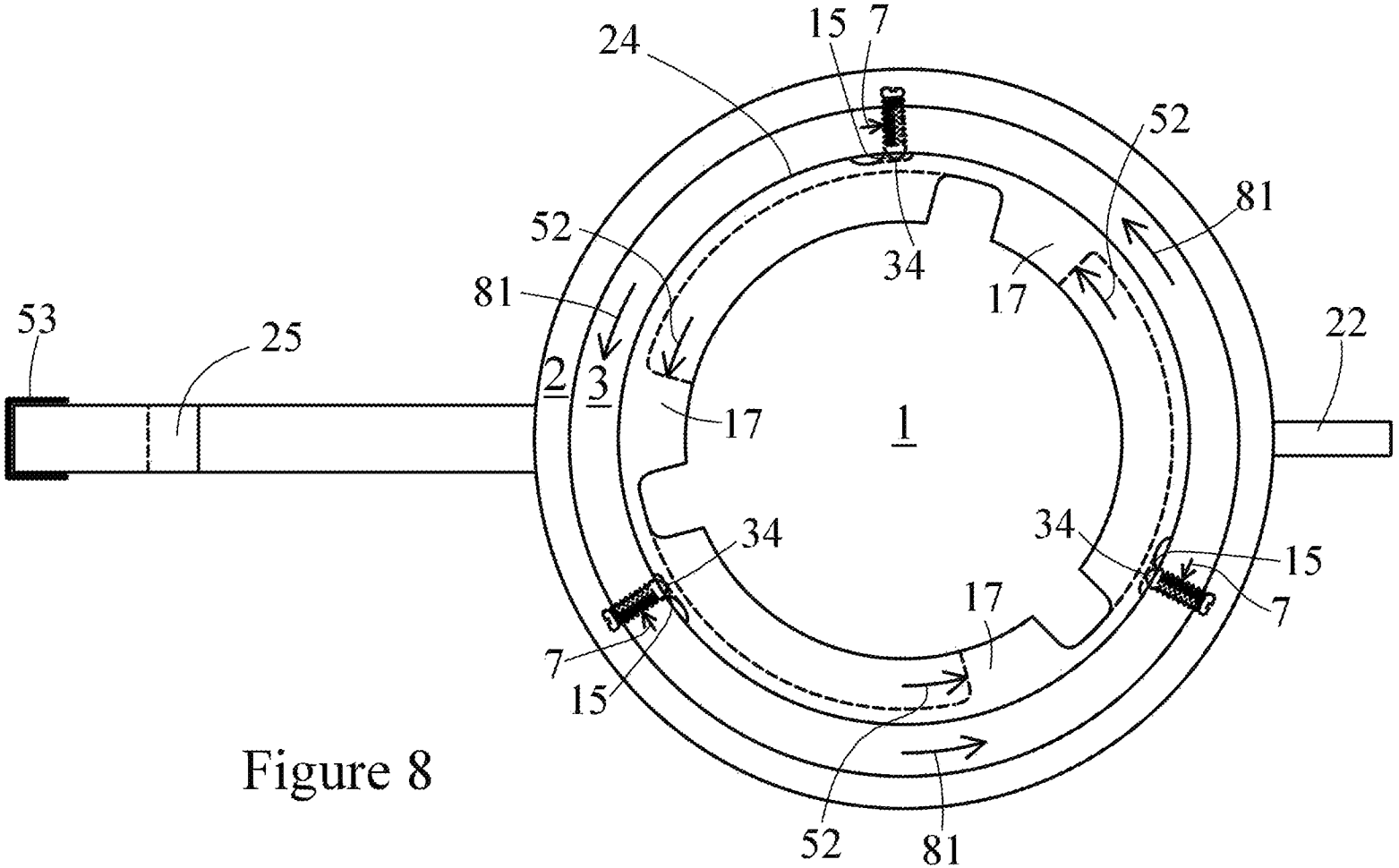
FIG. 8 is a top plan view of the configuration of FIG. 7.

So, starting from FIG. 5, referring to FIG. 4, and as is now seen in FIG. 7, the locking ring 3 is fitted and locked 7 by first aligning the inward protrusions 34 with the locking indentations 15, then moving the locking ring 3 down over the top portion of the hub 1 until the inward protrusions 34 reach the bottom of the vertical section of the inward protrusions 34, i.e., until the reach the vertex of the inverted L. Then, the locking ring 3 is rotated in a clockwise direction (as viewed from above) to move the locking indentations 15 to the terminal positions of the horizontal sections of the inward protrusions 34. In FIG. 7 this fit and lock operation 7 is shown by the descent and rotation arrows 7 about the centerline 41. In FIG. 8 the final locking step of this fit and lock operation 7 is shown by the rotational arrows 7 whereby the inward protrusions 34 are rotated horizontally through the locking indentations 15. Noting that the convention in the mechanical arts is to lock or screw together two components with a clockwise rotation and unlock or unscrew them with a counterclockwise rotation, it will be appreciated that the parity-inverted "L" of each locking indentation 15 is what causes locking with a clockwise rotation. But this does not preclude employing the opposite convention.

Following this fit and lock operation 7, it is seen from FIG. 7 that the locking ring 3 now sits about the circumference of the fluid-delivery hub 1 and above the fluid well ring 2, in a position that is snug but still permits free rotation. Specifically, by design, there is nothing in this fit and lock operation 7 which bars relative rotation between the fluid-delivery hub 1 and the fluid well ring 2, or which bars relative rotation between the locking ring 3 and the fluid well ring 2. But, the locking ring 3, being locked to the locking indentations 15 of the hub 1, will have its rotation tied to the rotation of the hub 1. So with the ring fixing member 25 fixed to a fixed location 53, the fluid-delivery hub 1 is still enabled to rotate while the fluid well ring 2 remains fixed without rotating. And, the fluid-delivery hub 1 and the locking ring 3 locked thereto will be enabled to rotate together, while the fluid well ring 2 remains fixed without rotating. Most importantly, although allowing rotation, the locking ring 3 will now prevent the fluid well ring 2 from moving in a vertical direction, and so will ensure that the fluid well ring 2 remains in a vertical lock to the fluid-delivery hub 1, while the relative rotation between the fluid well ring 2 and the fluid-delivery hub 1 remains fully enabled.

Then, referring to FIG. 8, when a driving force 52 is applied to the hub 1 by the rotary-motion flooring machine 140 (as will be detailed in FIG. 14), and when the fluid well ring 2 simultaneously remains fixed to a fixed location 53 on the rotary-motion flooring machine 140 via its ring fixing member 25, the locking ring 3 will rotate 81 with the rotational driving 52 of the hub 1, independently of the fluid well ring 2, while the locking ring 3 also prevents the fluid well ring 2 from vertically separating from the hub 1 in the vector direction opposite the arrows 5 in FIG. 5. It is preventing the vertical separation of the fluid well ring 2 from the hub 1 in this manner, while still enabling the hub 1 to rotate independently from the fluid well ring 2, which is the quintessential function of the locking ring 3.

It is now seen that the reason for choosing a preferred number of three (3) locking indentations 15 and inward protrusions 34 rather than some other number, and of having these be substantially equidistant from one another, is to establish a tripod of positions for the locking ring 3 to lock to the hub 1 to bar the vertical separation of the fluid well ring 2 from the hub 1. This is because of the natural mechanical stability provided by a tripod of contact points. More generally, irrespective of the detailed implementation, the fluid-delivery hub 1 and the locking ring 3 are configured to mate with one another for securing the locking ring 3 in a fixed position about and relative to the fluid-delivery hub 1.

It will also be seen from the side view FIG. 7 of the fully-assembled combination of the fluid-delivery hub 1, the fluid well ring 2 and the locking ring 3, and also from FIG. 8 which is the top plan view of the same, that irrespective of the exact details of each of these components, what is most important is that in this fully-assembled configuration of FIGS. 7 and 8: a) the locking ring 3 still enables the hub 1 to rotate while the fluid well ring 2 is held fixed 25, 53; and b) the locking ring 3 holds the fluid well ring 2 in a vertical position such that the fluid well 23 remains fluidically-sealed over the fluid entry openings 11 while the hub 1 rotates relative to the fixed fluid well ring 2. Any specific configurations for the fluid-delivery hub 1, the fluid well ring 2 and the locking ring 3 separately and/or together, which achieve these two primary goals, are regarded to be within the scope pf this disclosure and its associated claims, even if the implementation details vary from what has been specifically illustrated here.

Figure 11:
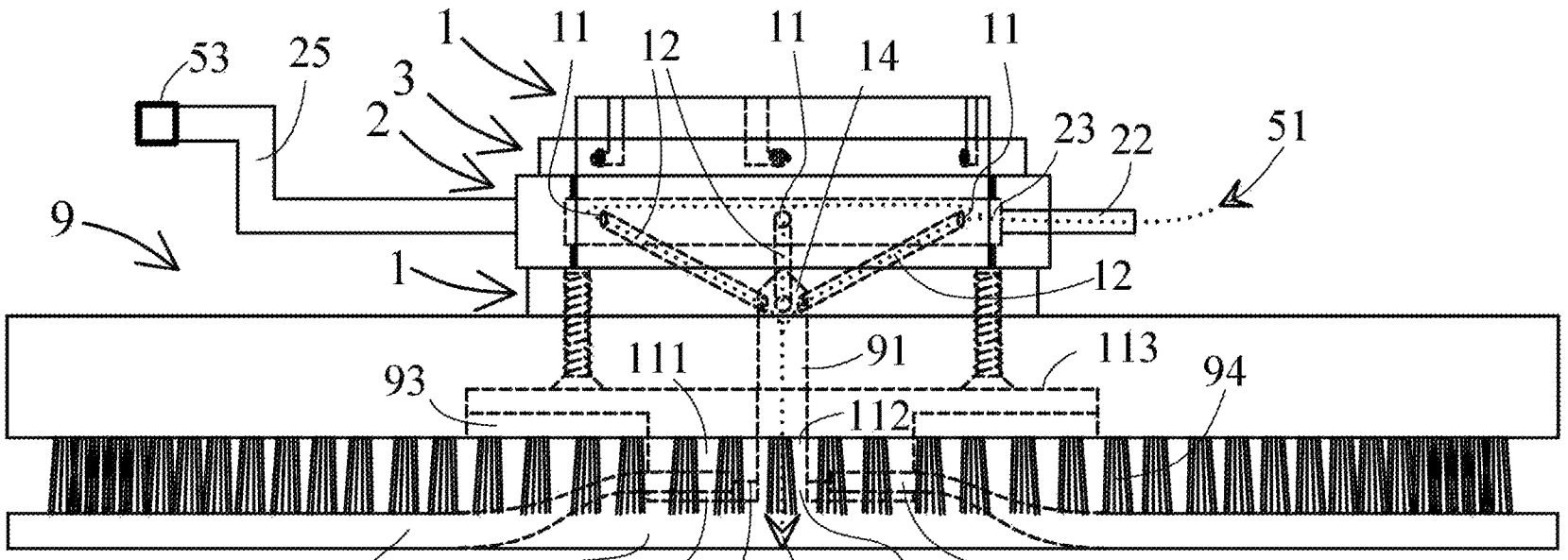
FIG. 11 illustrates a side plan view of the assembly of FIG. 10, after further assembly with the fluid well ring of FIG. 2 and the locking ring of FIG. 3, and after a floor-operation pad has been mounted to the bottom of the pad driver.

Having established how the combination of the fluid-delivery hub 1, the fluid well ring 2 and the locking ring 3 enables fluid to be delivered through the bottom center of the hub 1 while the hub 1 is rotating, now we turn to showing how this assembly is used to deliver fluid to a floor from the center of a rotating floor-operation pad 110 first shown in FIG. 11, while this floor-operation pad 110 is rotating together with the hub 1.

Figure 9A:
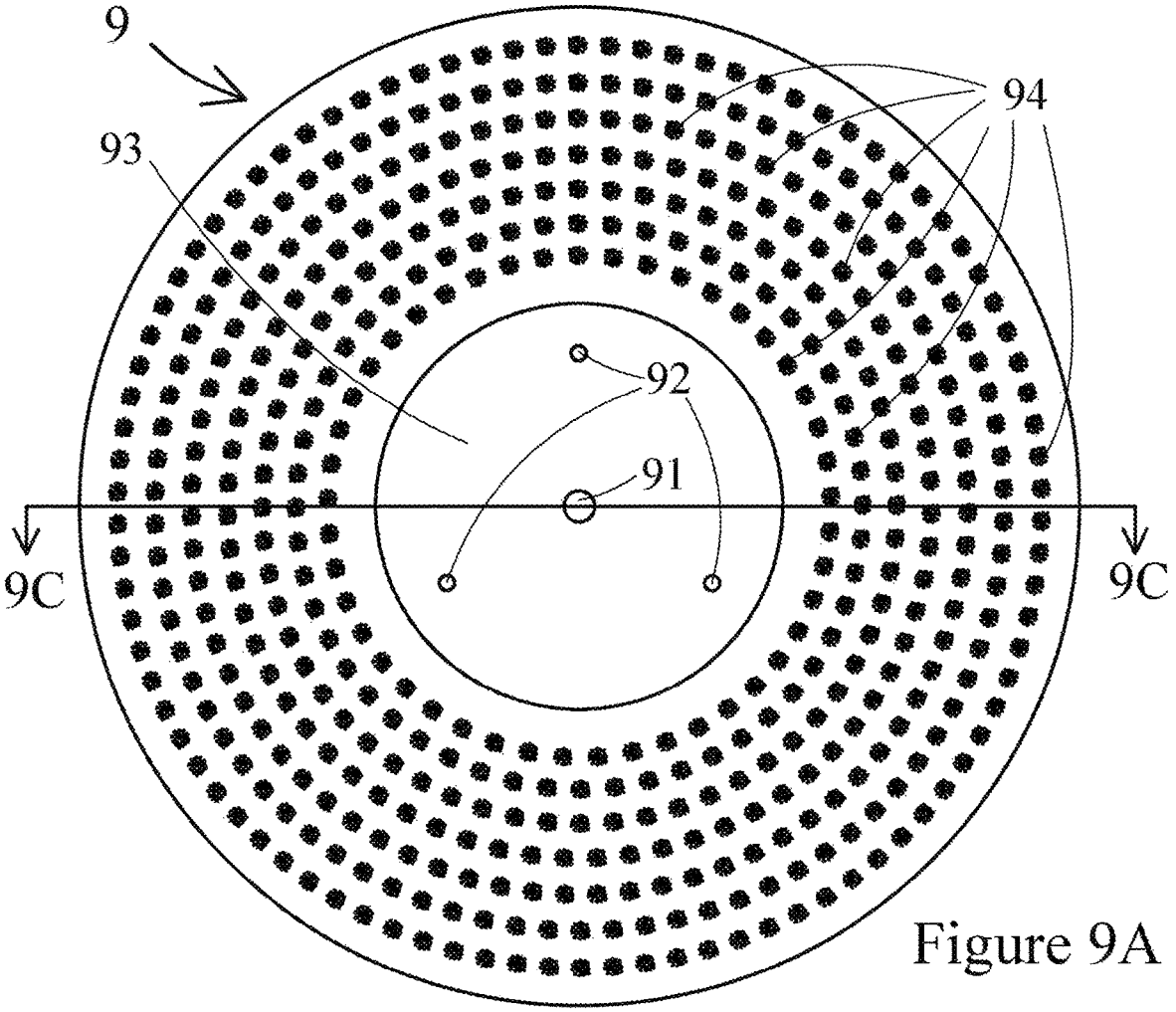
FIGS. 9A and 9B respectively illustrate bottom and side plan views of a pad driver used in connection with the invention.
Figure 9B:
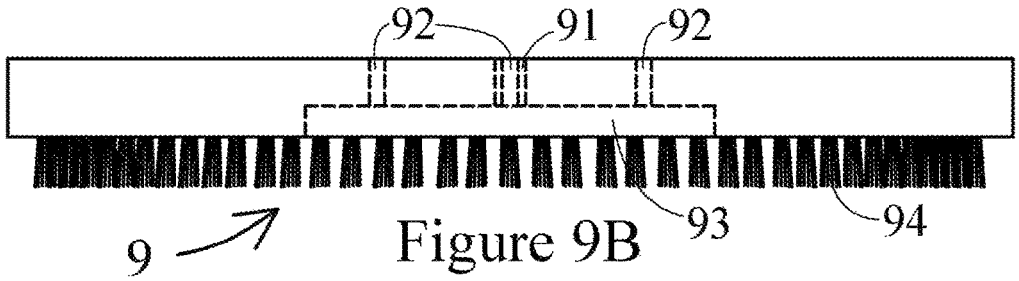

We begin with FIGS. 9A and 9B which respectively illustrate bottom and side plan views of a pad driver 9 used in connection with the invention. This pad driver 9 will be familiar in its essential features from the prior art. But a particularly important aspect of the pad driver 9 illustrated for use in connection with the present invention is that it has a pad driver aperture 91 passing through its center as illustrated. This pad driver 9 further contains a set of hub attachment holes 92 or a functional equivalent via which it may be attached to the bottom of the hub 1 at the floor-operation interface 19 seen in FIG. 1, using screws, bolts or equivalent attachment devices or means 101 as illustrated in FIG. 10. The pad driver aperture 91 is best seen by comparing FIG. 9A with the side cross sectional view of FIG. 9C taken along the line 9C-9C, because in FIG. 9B the pad driver aperture 91 is juxtaposed with one of the hub attachment holes 92 which is behind the pad driver aperture 91 from the side view of FIG. 9B.

Figure 12:
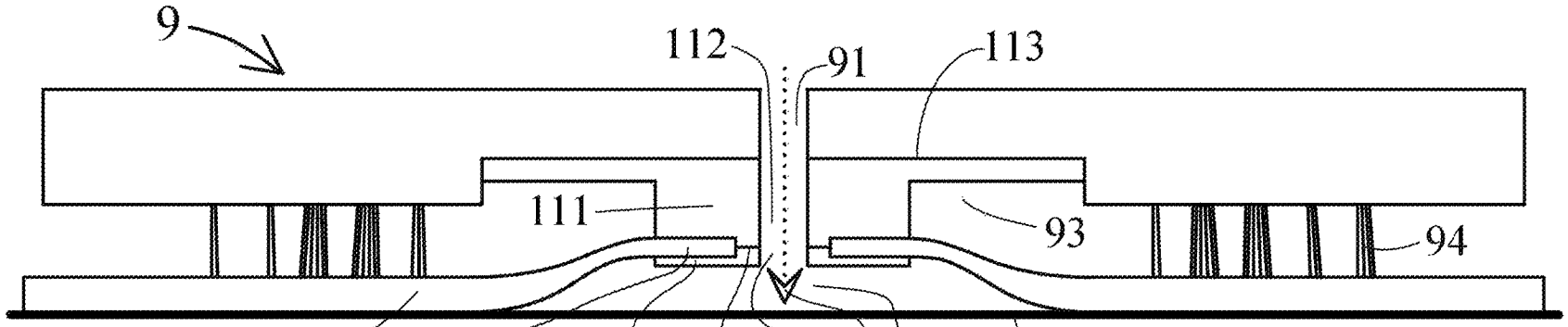
FIG. 12 illustrates a cross section of the floor-operation pad, mounted to the bottom of the pad driver taken from the side cross-sectional view of FIG. 9C.

Illustrated in the central region of the pad driver 9 is a fluid pool recess 93 which as will soon be elaborated is used to create a central region beneath the floor-operation pad 110 within which fluid 51 may be accumulated while a horizontal underfoot surface 120 (e.g., a floor) first depicted in FIG. 12 is being operated upon. As with the pad driver aperture 91, this fluid pool recess 93 is perhaps best seen from the side cross sectional view of FIG. 9C. In the non-central region of pad driver 9 are a large plurality of driver brushes 94 in a configuration that is common in the prior art. These driver brushes 94 are used for driving a separate and distinct floor-operation pad 110 in a manner that is also well-known in the prior art. It will be noticed that in FIG. 9A, all, part, or none of some of the individual brushes 94 are touched by the line 9C-9C. Accordingly and correspondingly, appearing in the side cross section of FIG. 9C is all, part, or none of these same individual brushes 94.

As was already previewed, FIG. 10 illustrates a side plan view of the pad driver 9 attached to the fluid-delivery hub 1. In hidden lines, it will be seen how two screws, bolts or functionally-equivalent attachment devices or means 101 make use of the floor-operation interface 19 in hub 1 and the hub attachment holes 92 or equivalent in the pad driver 9 to attach the pad driver 9 to the fluid-delivery hub 1. Not illustrated in the center of FIG. 10 simply to avoid confusion by creating too much clutter, is a third attachment 101 using the top holes of 19 and 92 seen in FIGS. 1C and 9A respectively. Regarding this attachment, the number of attachment points can be varied within the scope of this disclosure and its associated claims. Further, it is irrelevant how this attachment is achieved—for example not limitation, these may even be glued or welded together—so long as the pad driver 9 is attached to the fluid-delivery hub 1 in such a way as to result in the combined configuration illustrated in FIG. 10. Generally, in the best practice of this invention, the pad driver 9 will be attached to the fluid-delivery hub 1 once, and then left permanently attached; which is to say that there is no good functional reason for ever detaching the pad driver 9 from the fluid-delivery hub 1 once these have been attached together.

Next we turn to FIG. 11, which is a side plan view of the assembly of FIG. 10, but now with the following three further additions: First, in FIG. 11 the fluid well ring 2 has been placed and fluidically-sealed 24 (not numbered in FIG. 11) around the fluid entry openings 11 of the hub 1 as earlier disclosed in connection with FIGS. 5 and 6. Second, the locking ring 3 has been placed around the hub and above the fluid well ring 2 to lock the fluid well ring 2 in place while enabling the same to rotate relative to the hub 1 as earlier disclosed in connection with FIGS. 7 and 8. Third, FIG. 11 for the first time introduces a floor-operation pad 110 that has been mounted to the bottom of the pad driver 9 and is separate and distinct from the pad driver 9. This floor-operation pad 110 may be attached to and detached from the pad driver 9 at will, whereby different types floor-operation pad 110 may be interchangeably used in connection with the invention. This mounting of floor-operation pad 110 to the bottom of the pad driver 9 and the resulting configuration has some important features which are now reviewed in FIGS. 12 and 13. These features are shown in hidden lines in FIG. 11, but are brought out more clearly in FIG. 12.

Figure 9C:
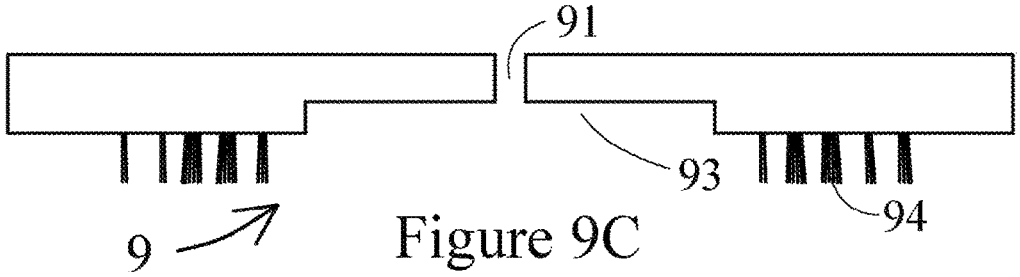
FIG. 9C illustrates a side cross sectional view taken along the line 9C-9C of FIG. 9A. These are all drawn to the same relative scale, so that a visual projection of vertical lines from one to the other serves to map the views into one another.
Figure 10:
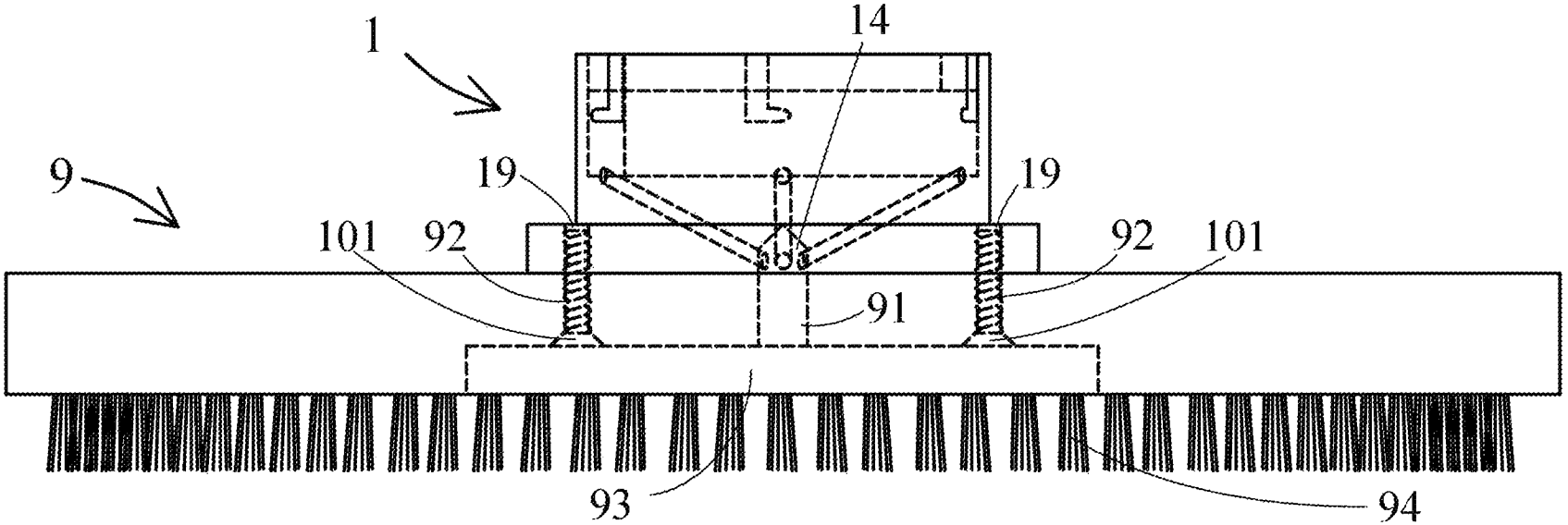
FIG. 10 illustrates a side plan view of the pad driver from the view of FIG. 9B, attached to the fluid-delivery hub from the view of FIG. 1B.
Figure 13:
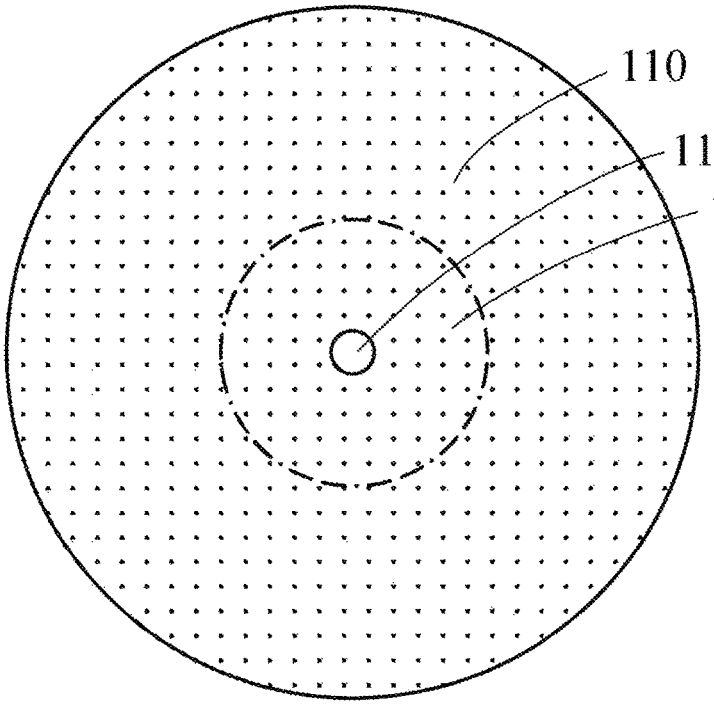
FIG. 13 illustrates a bottom plan view of the floor-operation pad.

FIG. 12 illustrates the floor-operation pad 110 mounted to the bottom of the pad driver 9, with the pad driver 9 as illustrated in the side cross-sectional view of FIG. 9C. In this cross section we see an upper pad restraint 111 with a pad restraint fluidic channel 112 running through its center as illustrated, attached 113 to the underside of the pad driver 9. This attachment along 113 is secured using bolts or screws or adhesives or welds or the like, and is not specifically detailed because all that matters is that this attachment be effectuated at 113 irrespective of how that is done. Attachable to and detachable from the bottom of upper pad restraint 111 at a restraint attachment interface 114 is a lower pad restraint 115. Also shown for the first time in FIG. 12 is the horizontal underfoot surface 120 e.g., floor being operated upon. In FIG. 13 we see a bottom plan view of the floor-operation pad 110, with an operation pad aperture 116 passing through its center. A central pad region 121 is bounded by the broken boundary line in the FIG. 13 illustration.

So, referring to FIG. 12, the process for attaching the floor-operation pad 110 to the underside of the pad driver 9 is as follows: First, with the attachment at 113 already secured, the operation pad aperture 116 of the floor-operation pad 110 is placed about the lower part of the upper pad restraint 111. Then, the lower pad restraint 115 is attached to the upper pad restraint 111 at the restraint attachment interface 114 with the inside circumference of the floor-operation pad 110 tightly wedged between the upper 111 and the lower 115 pad restraints. For detachment of the floor-operation pad 110 from the pad driver 9, this process is reversed: the lower pad restraint 115 is detached from the upper pad restraint 111, and then so too is the floor-operation pad 110. At a later time, a different type of floor-operation pad 110 may be employed, whereby different types of floor-operation pad 110 modules may be interchangeably used in connection with the invention.

The vertical distance between the upper 111 and the lower 115 pad restraints in the locale where the floor-operation pad 110 is lodged, is configured to wedge the floor-operation pad 110 very tightly between the upper 111 and the lower 115 pad restraints. In particular, this wedging added to the contact of the driver brushes 94 against the top surface of the floor-operation pad 110 must be tight enough so that when the pad driver 9 rotates against the horizontal underfoot surface 120 with weight, so too will the floor-operation pad 110 synchronously rotate. The attachment at the restraint attachment interface 114 may be implemented using any one of a number of well-known devices and methods for providing secure, tight attachment and simple detachment, such as strong secure clips and snaps and the like, so long as the functional characteristics just described are achieved.

Further, the vertical height of the upper 111 and the lower 115 pad restraints is configured in the fluid pool recess 93 with an elevation above the top surface of the horizontal underfoot surface 120 so that the central pad region 121 of the floor-operation pad 110 is likewise elevated above the horizontal underfoot surface 120 even while the outer portion of the floor-operation pad 110 beneath the driver brushes 94 is firmly in contact with the horizontal underfoot surface 120. As a result, the central pad region 121 becomes synonymous with a fluid pool region also designated 121 under the bottom center of the pad 110.

This is important, because when the fluid 51 is delivered to the center of the hub 1 and all the way down through the center of the floor-operation pad 110 via the pathways illustrated by the dotted lines in the full assembly of FIG. 11, the central pad region 121 will define a fluid pool region 121 in which the fluid becomes pooled. But because the fluid 51 is delivered to the center of the pad and deposited in the fluid pool region 121, it will not be flung outside the outside circumference of the floor-operation pad 110. Rather, it will only be applied to the horizontal underfoot surface 120 from the center of the floor-operation pad 110 working outwards. This results in a clean, even, consistent application of the fluid to the horizontal underfoot surface 120, without spotting and without creating a mess, thereby achieving the overall object of the invention. This is in contrast to the prior art where fluid is applied outside the floor-operation pad 110 and must be worked inward, or the pad 110 needs to be repeatedly lifted to introduce fluid 51 under the pad 110, resulting in a spotty, inconsistent and messy application of fluid.

It has already been stated that FIG. 13 illustrates a bottom plan view of the floor-operation pad 110, with the operation pad aperture 116 passing therethrough and with the central pad region 121 bounded by the broken boundary line with is geometrically illustrative, not an actual physical line. The bottom surface of this floor-operation pad 110 is what contacts the workpiece below, namely the horizontal underfoot surface 120. This floor-operation pad 110 which is attached to the pad driver 9 in the manner just reviewed is an interchangeable module that will vary in character depending upon the operation being performed on the floor. The dots illustrated over the bottom surface represent the material features of the pad that make the pad useful for whatever operation is intended. These bottom surface features may optionally be omitted from the central region 121 because as already discussed in connection with FIG. 12, this corresponds with the fluid pool region 121 where the floor-operation pad 110 is elevated above and so does not need to make contact with the horizontal underfoot surface 120. The three main applications for the floor-operation pad 110 and the material features that implement these are as follows:

First, applying a fluid 51 comprising a finishing fluid such as stain, polyurethane, epoxy, cleaner, solvent and/or wax, for the purpose of finishing or cleaning or polishing/buffing the horizontal underfoot surface 120 of a regular floor. For these uses the bottom surface of the floor-operation pad 110 may comprise, for example not limitation, carpet, a non-woven fabric (which is a standard floor cleaning pad), a woven fabric, a cloth fabric, lamb's wool, synthetic wool, sponge, steel wool, a brush, a squeegee brush, or any combination of any above, or functional equivalents.

Second, applying a fluid 51 comprising water, a cutting fluid, or even forced air, for the purpose of sanding the horizontal underfoot surface 120 also of a regular floor. For sanding, the bottom surface of floor-operation pad 110 may comprise, for example not limitation, a felt pad, a sandpaper disc, a sanding screen abrasive, a sanding sponge, a metal sanding disc with abrasives such as diamond or other common abrasives, or any combination of any above or their functional equivalents. It may be desirable to deliver water or another fluid when sanding because then the sanding will produce a wood slurry rather than dry wood dust, with the slurry being far more manageable and cleaner than dust. This is also healthier because the dust is not kicked up into the air where it can be inhaled. Additionally, injecting water or another fluid when sanding is ideal to keep the abrasives lubricated for long life and a quality finish.

Third, applying a fluid 51 comprising water or another cutting fluid or forced gas for the purpose of grinding the horizontal underfoot surface 120, which horizontal underfoot surface 120 may now be understood and more broadly defined not only as the floor of a typical indoor space, but also as an outdoor underfoot surface such as concrete or stone or the like. For grinding, the bottom surface of the floor-operation pad 110 may comprise a commercially-available metal plate with diamonds or other abrasives attached, or a commercially-available brush which has bristles that are abrasive, or any combination of the above. It is desirable to deliver water or another fluid when grinding concrete or stone because then the grinding will produce a mineral slurry rather than dust, with the slurry again being far more manageable and cleaner than dry dust. And again this is healthier because the dust slurry is not kicked up into the air. And likewise, again, injecting water or another fluid when grinding is ideal to keep the abrasives lubricated for long life and a quality finish.

It should finally be noted that while this invention has been illustrated with the pad driver 9 being a separate component from the floor-operation pad 110, combining these two components into a single component is also regarded to be within the scope of this disclosure and its associated claims. In such a configuration, the driver brushes 94 are omitted, and these are directly replaced by the underside surface features represented by the multiple dots in FIG. 13. In this circumstance, there is no need to follow the steps of reviewed in connection with FIG. 12 for attaching and detaching the floor-operation pad 110 to the pad driver 9 because both functions are merged into one component.

Finally, FIG. 14 illustrates a side plan view of the entire working assembly of FIG. 11 as further elaborated in the foregoing discussion of FIGS. 12 and 13, mounted to a rotary-motion flooring machine 140, thereby configured to operate upon, and operating upon, a horizontal underfoot surface 120 e.g., a floor. To reach the configuration of FIG. 14, one first assembles the entire combination of elements illustrated and discussed in FIG. 11, which combination is also seen at the bottom of FIG. 14. This combination is then mated to the rotary-motion flooring machine 140 at two points of contact, one rotational, one fixed, as will now be reviewed.

As to rotational contact, the rotary device mating interface 16 and rotational drive contacts 17 within the top part of the fluid-delivery hub 1 are mated to a rotation driver (hidden proximate the reference number 141 in FIG. 14) of the rotary-motion flooring machine 140. This is simply a standard interface connection commonly used in the prior art to mate any floor-operation pad 110 to the bottom of a rotary-motion flooring machine 140 so that the pad 110 can be rotationally driven and operate on the horizontal underfoot surface 120. For example, not limitation, returning to FIG. 1A, the illustrated device mating interface 16 comprises a triplet of illustrated slots into which driving members (not shown, but just below 141) of the rotation driver of the rotary-motion flooring machine 140 are matably-inserted. Then, with an approximate quarter turn the driving members beneath 141 are rotated to butt up against the rotational drive contacts 17. Then, when the rotary-motion flooring machine 140 is powered on and its driver is rotating, the driving members beneath 141 exert a rotational driving force at the positions illustrated by the arrows 52 in FIGS. 6 and 8, resulting in a counterclockwise motion when viewed from above. It is to be understood that this rotational driving interface, and whether it is clockwise or counterclockwise, is entirely illustrative and exemplary, and not at all limiting. Any such interface used in the art at present, or which may be used in the future, is encompassed within the scope of this disclosure and its associated claims. The simple point is that the top portion of the hub 1 is designed to mate with the rotational driving interface of whatever particular rotary-motion flooring machine 140 it is designed to be used with.

As to the fixed contact, FIG. 14 illustrates the fluid ring fixing restraint 53 affixed to a non-rotating position, for example not limitation, on the underside of the rotary-motion flooring machine 140. This fluid ring fixing restraint 53 was illustrated and discussed in connection with FIGS. 5, 6, 7 and 8. As already disclosed, the fluid ring fixing member 25 (e.g., arm) is then inserted into the fluid ring fixing restraint 53 so that the fluid well ring 2 is now restrained from rotating while all other components attached to the hub 1 do rotate. These rotating components include the hub 1 itself, the locking ring 3, the pad driver 9 and the floor-operation pad 110. So it should now be clear from all of the foregoing disclosure that that if fluid 51 can be introduced into the fluid introduction port 22 of the non-rotating (because it is fixed 53) fluid well ring 2, that fluid 51 will make its way to the central fluid pool region 121 where the floor-operation pad 110 is elevated above and does not contact the horizontal underfoot surface 120, simultaneously with the floor-operation pad 110 rotating and operating on the horizontal underfoot surface 120, achieving the primary object of the invention. So what remains is a convenient way to introduce the fluid 51 into the fluid introduction port 22.

Shown as an example without limitation, the fluid management system in FIG. 14 recognizes that the operator/user of the rotary-motion flooring machine 140 will operate the machine 140 by holding the machine by its handle 142, so that the fluid management system should preferably be actuated proximate the handle 142. So, a fluid source 143 e.g., a fluid bag is mounted at a convenient location below the handle 142, with a fluid insertion inlet 144 through which the fluid source 143 is filled. This fluid source 143 is fluidically connected to the fluid introduction port 22 via a fluid transit conduit 145. Fluid 51 in the fluid source 143 e.g., bag then travels to and into the fluid introduction port 22 via the fluid transit conduit 145, managed by the operator actuating the schematically-illustrated valve/pressure/metering system which is referred to generally as the fluid management system 146.

Specifically, the fluid management/valve/pressure/metering system 146 connects a position just below the handle 142 with a device receiving fluid from the bottom of the fluid source 143, such that the flow rate of fluid 51 and/or the pressure of fluid 51 being flowed forward to the fluid introduction port 22 can be controlled by the operator. This includes entirely turning off the fluid flow when desired (i.e., flow rate equals zero) and/or not applying any pressure (i.e., applied pressure equals zero) so that all pressure originates solely from the weight of the fluid in the gravitational field. This may also include applying negative pressures, i.e., a vacuum, as will momentarily be discussed. Further, this system may include meters which monitor how much fluid has been transported into the fluid introduction port 22 and/or the flow rate (fluid per time unit) and provide this information to the user/operator.

In other words, the rotary-motion flooring machine 140 in this configuration comprises a fluid management system 146 for managing at least one fluid parameter selected from the fluid parameter group consisting of: a flow rate of said fluid 51 from said fluid source 143 into said fluid introduction port 22; an applied positive flow pressure of said fluid 51 from said fluid source 143 into said fluid introduction port 22; an applied negative (i.e., vacuum) flow pressure of said fluid 51 from said fluid source 143 into said fluid introduction port 22; a quantity of fluid 51 having flowed from said fluid source 143 into said fluid introduction port 22; and a rate at which fluid 51 flows from said fluid source 143 into said fluid introduction port 22. It is understood that the management of these fluid parameters may entail controlling these parameters and/or monitoring and/or metering these parameters.

If the fluid is air or a gas as was earlier mentioned may be suitable for some sanding and grinding applications, then a pump providing pressure becomes a desirable element to provide whatever rate of gas flow is desired. This connection between the operator's hands at 142 and the valve and/or pump at the bottom of 146 may be entirely mechanical employing non-signal connection wires, and/or it may involve mechanical elements such as valves and/or pumps which are electronically controlled via wired and/or wireless digital and/or analog information signaling.

So, using the complete configuration of FIG. 14, the operator fills the fluid source 143 with whatever fluid 51 is to be employed via the inlet 144 (if the fluid 51 is ambient air, the bag is obviously not needed), turns on the rotary-motion flooring machine 140, and using the fluid management system just described, transports fluid 51 into the fluid pool region 121 beneath the center of the rotating floor-operation pad 110 at whatever flow rate and/or at whatever pressure is desired by the operator. And with this, all of the objects of the invention are embodied and achieved.

This invention heretofore disclosed eliminates the problem whereby the rotational motion of floor buffers and similar floor-operation pads 110 sling fluid 51 into undesirable places and unevenly apply fluid 51 to the places on the horizontal underfoot surface 120 where an even application is desired. This problem is eliminated, simply, by introducing the fluid 51 into the center of the floor-operation pad 110 which is the pad or abrasive surface that makes contact with the floor or other flat horizontal underfoot surface 120 below the device, while that floor-operation pad 110 is rotating. Preferably, the central pad region 121 is sufficiently elevated for this region to become a fluid pool region also designated 121 under the bottom center of pad 110.

In a preferred embodiment, for example not limitation, fluid 51 is stored in a fluid source 143 e.g., a fluid bag, above the height of the contact area at 120 for gravity feed, as shown in FIG. 14. This does not, however, preclude the fluid source 143 being stored in a lower position. Nor does it preclude transporting the fluid 51 to the fluid introduction port 22 using a positive pressure feed from the fluid management system 146. For example, not limitation, having to repeatedly refill a bag embodiment of 143 may be inconvenient, and/or it may be desired to not bring the fluid containers 143 indoor to avoid spillage or accumulation of fumes in an indoor space. So instead, large containers 143 of fluid 51 may be kept on a service vehicle or in a nearby location outdoors, with the fluid transit conduit 145 comprising a long hose running from the container 143 presently in use over to the fluid introduction port 22 under applied pressure from the fluid management system 146.

Likewise, the container 143 may be rigid or a flexible bag or drum, etc., any of which may be disposable or reusable. When carried on the rotary-motion flooring machine 140, the bag 143 is attached using a bracket that mates to both the bag 143 and the machine 140 (preferably, but without limitation proximate the handle 142) using bolt or screws or the like. The fluid in this embodiment flows by gravity or through a pump to a flow control and metering device e.g., valve which also can start, stop, and generally regulate and/or meter the flow, all as part of the fluid management system 146. Or as just noted, the fluid 51 may flow via a separate flexible tube/hose 145 to the device.

The invention, at its heart, employs a rotary coupling comprising the fluid-delivery hub 1 and the fluid well ring 2 which are configured to allow fluid 51 to enter the center of the floor-operation pad 110 and be dispersed directly to contact area of the pad 110 starting only proximate the central pad region 121, below the pad 110, in the fluid pool region also designated 121. The fluid flow channels 12 are angled so the fluid can flow down using gravity to counteract the centrifugal effects of rotational forces. These fluid flow channels 12, optionally, may also be tapered with a wider cross sectional area near the outer perimeter of the hub 1 so as to more-readily accept incoming fluid 51, or toward the center of the hub 1 for vacuum applications to be momentarily elaborated.

Fluid 51 delivered to the horizontal underfoot surface 120 through the bottom center of the floor-operation pad 110 will naturally disperse throughout the entire pad 110 due to both the rotation of the pad 110 and to any lateral movement induced by the device operator. Because of the operation pad aperture 116 and its configured alignment with the fluid dispensing opening 14 and (depending on embodiment) the pad driver aperture 91 and the pad restraint fluidic channel 112 (see FIG. 11 for the best representation of this alignment), the fluid 51 never reaches the top surface of the floor-operation pad 110 from which it can be flung in an undesirable manner. Fluid only emanates outward from the bottom center of the pad 110, as desired. This also reduces fluid waste, because fluid 51 is dispensed only at the contact area and applied evenly, without slinging to undesirable locations. And again, the optional but preferred elevation of the central pad region 121 creates a fluid pool region also designated 121 under the bottom center of the pad 110 for optimum application of the fluid 51 to the horizontal underfoot surface 120.

The method of using of this invention yields an even distribution of fluid 51. For example, if wood stain or polyurethane is being applied, the stain or polyurethane is applied evenly without slinging and splashing. The fluid management system 146 allows complete control of the fluid 51 reducing waste and ensuring an even application. The fluid management system 146 also allows for different viscosities of fluid to be applied. And if the fluid management system 146 comprises a pressure pump, this also allows for a larger variety of viscosities to be used.

This fluid-delivery hub 1 and fluid well ring 2 which are at the heart of the invention can be fixed to the rotating machine permanently, that is, rotary-motion flooring machines 140 can be manufactured ab initio to incorporate the core configuration of this invention. Alternatively, as has been illustrated throughout the drawings, the invention may be embodied as an attachment retrofitted to preexisting rotary-motion flooring machines 140. This allows the invention to be removed at will, allowing for prior art uses of the rotary-motion flooring machine 140 when it is not necessary to apply fluid 51 in a given project or a given phase of a project. And it enables users of those preexisting machines 140 to utilize those machines to practice this invention, without having to purchase new machines 140.

In a preferred embodiment the ring fixing member 25 is an arm which attaches to or contacts the rotary-motion flooring machine 140 and acts as an anchor for the non-rotating fluid well ring 2. Alternatively, in lieu of this arm one may employ a different type of ring fixing member 25 as an anchor, such as a pin or other bar that either directly bolts to the machine 140 or fits into a hole or slot or other mounting device bolted or otherwise fixed to the bottom of the machine 140. The mount may be bolted using the preexisting buffer motor or gearbox screws, for example not limitation.

The fluid-delivery hub 1 is either bolted or adhered etc. directly, or attached by a quick release coupling, to the pad driver 9. The fluid well ring 2 which fits over the hub comprises a pair of sealing rings 24 located on the top and bottom of the fluid well ring 2. This may also include an optional center ring bearing (not shown) to facilitate good rotational action. Alternatively, the seals 24 may be mounted on the hub 1 in lieu of the fluid well ring 2 because the essential goal is to establish the sealed 24 fluid well 23 in the region best seen in FIG. 6, see also FIGS. 2B, 2C and 5. There may be a bearing above and/or below the fluid well ring 2 that captures and holds the fluid well ring 2 into its location.

At the top center of the hub 1 there is a quick-connect industry-standard drive coupling exampled without limitation by 16 and 17 that connects (the retrofitted embodiment of) the invention to the rotary-motion flooring machine 140. The net result is that this configuration allows the hub 1 to rotate and the fluid well ring 2 to remain stationary. The locking ring 3 may be a separate component as illustrated; alternatively it may be part of the rotary-motion flooring machine 140 itself, positioned so as to lock in fluid well ring 2. The non-limiting configuration illustrated in the drawings, enables easy removal and cleaning of the fluid well ring 2 and associated parts, without needing any separate tools for assembly and disassembly. The same is true if the locking ring 3 is part of the rotary-motion flooring machine 140 itself. While it is alternatively possible for the fluid-delivery hub 1, the fluid well ring 2 and the locking ring 3 to be fabricated in a permanent configuration which cannot be disassembled by making permanent the attachment of the locking ring 3 to the hub 1 (whereby the assembly if FIGS. 7 and 8 can never come apart), this is less preferred, precisely because disassembly enables more thorough cleaning between uses.

Optionally, the invention may also employ one or more optional spacers (not illustrated) which also serve as bearing surfaces. The locking ring 3 then locks the fluid well ring 2 and any optional spacers in place so they cannot come off the hub.

Fluid 51 flows into the fluid well ring 2 via the fluid transit conduit 145 which may be, e.g., a hose, a tube, or piping. The fluid well 23 may be implemented in part by etching a groove along the inside circumference of the fluid well ring 2 and/or the outside circumference of the fluid-delivery hub 1. Additionally, noting that many prior art pressure pumps make use of rotary motion to generate pressure, the invention may be designed wherein the rotational motion simultaneously serves as part of a pump which provides positive or negative pressure as part of the fluid management system 146.

For the pad driver 9, it is possible to employ an industry-standard center-mounted pad holder with a center hole or additional holes for the fluid to exit, and/or to hold the floor-operation pad 110 in its desired location. This includes pulling the central pad region 121 upwards to create the fluid pool region also designated 121 allowing the fluid 51 to pour under the center of the pad 110 and disperse along the junction of the pad 110 and horizontal underfoot surface 120. A washer (not shown) may also be used to pull the pad 110 up into a bevel to create the desire fluid pool 121. The pad 110 in this instance must have the proper sized hole so a washer or standard pad holder can pull it up to create the pool 121.

Finally, while the disclosure throughout has been focused on delivering fluid 51 to the bottom center of the floor-operation pad 110, an important application of this invention makes use of the fluid management system 146 applying a negative pressure, i.e., a vacuum, whereby a fluid 51—which is understood and defined to include ambient air—is drawn from the bottom center of the floor-operation pad 110, out through the fluid introduction port 22 (which is then a fluid extraction port 22) and the fluid transit conduit 145, and into the fluid source 143 (which is then in the nature of a vacuum accumulation bag 143). This reverse pressure, vacuum method has a variety of uses for cleanup operations and/or for providing a cleaner operation in the first place. Two non-limiting examples are discussed below.

First, in the circumstance where the floor-operation pad 110 is a sanding pad, and where the operation to be performed is dry sanding, the fluid management system 146 is actuated to create a vacuum, so that as dust is generated by the sanding operation, instead of being flung outward and kicked up, it is sucked toward the center of the floor-operation pad 110, through the rest of the system, and accumulated in what is now the vacuum accumulation bag 143. In this way, the operation proceeds more cleanly in the first place.

Second, in circumstances where a fluid 51 is introduced for sanding or grinding applications to create a dust slurry so that dry dust is not flung or kicked up, there is still a slurry on the horizontal underfoot surface 120 after that application is completed. This slurry still needs to be cleaned up. So now, a first floor-operation pad 110 which is a sanding or grinding tool is removed and replaced with a second floor-operation pad 110 which is a cleaning tool. Then, with the fluid management system 146 actuated to create a vacuum, the fluid 51 is now the dust slurry, and that slurry is vacuumed up through the bottom center of the floor-operation pad 110, and drawn into what is again the vacuum accumulation bag 143 for disposal.

It is important to note that for these sorts of vacuum applications, the essential configuration of the invention remains unchanged. The only difference is that the fluid management system 146 applies a negative flow pressure a.k.a. vacuum, rather than a positive flow pressure, and that the fluid source 143 which starts out full and becomes empty, now is a vacuum accumulation bag 143 which starts out empty and becomes full.

The knowledge possessed by someone of ordinary skill in the art at the time of this disclosure, including but not limited to the prior art disclosed with this application, is understood to be part and parcel of this disclosure and is implicitly incorporated by reference herein, even if in the interest of economy express statements about the specific knowledge understood to be possessed by someone of ordinary skill are omitted from this disclosure. While reference may be made in this disclosure to the invention comprising a combination of a plurality of elements, it is also understood that this invention is regarded to comprise combinations which omit or exclude one or more of such elements, even if this omission or exclusion of an element or elements is not expressly stated herein, unless it is expressly stated herein that an element is essential to applicant's combination and cannot be omitted. It is further understood that the related prior art may include elements from which this invention may be distinguished by negative claim limitations, even without any express statement of such negative limitations herein. It is to be understood, between the positive statements of applicant's invention expressly stated herein, and the prior art and knowledge of the prior art by those of ordinary skill which is incorporated herein even if not expressly reproduced here for reasons of economy, that any and all such negative claim limitations supported by the prior art are also considered to be within the scope of this disclosure and its associated claims, even absent any express statement herein about any particular negative claim limitations.

Finally, while only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

I claim:

1. A system for delivering fluid to and from a bottom center of a floor-operation pad on a rotary-motion flooring machine while the pad is rotationally operating on a horizontal underfoot surface, said system comprising a fluid-delivery hub comprising:

a plurality of fluid entry openings disposed on an outside circumferential surface thereof;

an equal plurality of fluid flow channels commencing at said fluid entry openings, angling downward and inward from said fluid entry openings toward a center of said fluid-delivery hub, and terminating at an equal plurality of fluid exit openings proximate a bottom center of said fluid-delivery hub; and a floor-operation interface at a bottom of said fluid-delivery hub configured to directly or indirectly attach a floor-operation pad thereto, for operating on a floor.

2. The system of claim 1, further comprising a permanent attachment of said fluid-delivery hub to the rotary-motion flooring machine for causing said fluid-delivery hub to rotate when the rotary-motion flooring machine is operating.

3. The system of claim 1, said fluid-delivery hub further comprising a rotation-driving interface at a top region of said fluid-delivery hub configured to attachably and detachably mate said fluid-delivery hub to the rotary-motion flooring machine at will, for causing said fluid-delivery hub to rotate when the rotary-motion flooring machine is operating and when said fluid-delivery hub is attached to the rotary-motion flooring machine.

4. The system of claim 1, further comprising:

a fluid well ring, said fluid well ring comprising a ring body with an inside circumference thereof substantially the same as an outside circumference of said fluid-delivery hub proximate where said fluid entry openings are disposed;

said fluid well ring further comprising a fluid introduction port running thorough said ring body, commencing outside said ring body and terminating in a fluid well inside said ring body, for flowing fluid from outside said fluid well ring into said fluid well;

said fluid well ring further comprising a ring fixing member attached to said ring body;

said fluid well ring in combination with said fluid-delivery hub further comprising a pair of fluid-sealing rings also running outside said outer circumference of said fluid-delivery hub and inside said inside circumference of said ring body, said sealing rings defining and bounding and sealing said fluid well from above and from below;

said fluid-sealing rings configured to fit snugly between said outside circumference of said fluid-delivery hub and said inside circumference of said ring body;

said fluid-sealing rings further configured to permit relative rotation between said fluid well ring and said fluid-delivery hub;

said fluid well ring in combination with said fluid-delivery hub and said fluid-sealing rings forming said fluid well running inside said inside circumference of said ring body and outside said outside circumference of said fluid-delivery hub; wherein:

said ring fixing member is configured wherein when said ring fixing member is fixed to a non-rotating location on the rotary-motion flooring machine, said fluid well ring will not rotate while said fluid-delivery hub is being rotated by the rotary-motion flooring machine; and said fluid well ring is configured wherein when it is mounted about said outside circumference of said fluid-delivery hub proximate where said fluid entry openings are disposed, said fluid well will surround said fluid entry openings, while said fluid-sealing rings fluidically seals fluid in said fluid well against flowing between said fluid well ring and said fluid-delivery hub.

5. The system of claim 4, wherein fluid flowing into said fluid well ring via said fluid introduction port while said fluid-delivery hub rotates, flows through said fluid entry openings, through said fluid flow channels and out said fluid exit openings proximate said bottom center of said fluid-delivery hub.

6. The system of claim 4, further comprising a locking ring, said locking ring comprising:

a locking-ring body with an inside circumference thereof substantially the same as an outside circumference of said fluid-delivery hub proximate where said fluid entry openings are disposed; and a plurality of inward protrusions along said inside circumference of said locking-ring body; wherein:

said fluid-delivery hub and said locking ring configured to mate with one another for securing said locking ring in a fixed position about and relative to said fluid-delivery hub; and when said system is configured with said fluid well ring placed about said outside circumference of said fluid-delivery hub proximate where said fluid entry openings are disposed, and is configured with said locking ring secured in said fixed position about and relative to said fluid-delivery hub, vertical movement of said fluid well ring relative to said fluid-delivery hub is substantially prevented, but said relative rotation between said fluid well ring and said fluid-delivery hub is still permitted.

7. The system of claim 1, further comprising:

said floor-operation interface attached with a floor operation pad comprising: an operation pad aperture passing therethrough proximate a center thereof, and material features on an underside thereof for rotationally operating on the horizontal underfoot surface; wherein:

the configuration of said fluid-delivery hub in combination with said floor-operation pad enables fluid emerging from said fluid exit openings proximate said bottom center of said fluid-delivery hub to pass through said operation pad aperture and be delivered to the horizontal underfoot surface through said bottom center of said floor-operation pad.

8. The system of claim 7, wherein said configuration of said fluid-delivery hub in combination with said floor-operation pad additionally elevates a central pad region of said floor-operation pad above said underfoot surface, thereby establishing a fluid pool region under the center of said floor-operation pad for pooling the fluid delivered to the horizontal underfoot surface through said bottom center of said floor-operation pad.

9. The system of claim 1, further comprising:

a pad driver comprising a pad driver aperture passing therethrough proximate a center thereof, and a plurality of driver brushes for driving a separate and distinct floor-operation pad which floor-operation pads are attachable to and detachable from said pad driver interchangeably and at will;

said pad driver directly attached to said bottom of said fluid-delivery hub at said floor-operation interface; and said pad driver further comprising a restraint attachment interface configured wherein said floor-operation pads are enabled to be attachable to and detachable from said pad driver, at will; wherein:

the configuration of said fluid-delivery hub in combination with said pad driver enables fluid emerging from said fluid exit openings proximate said bottom center of said fluid-delivery hub to pass through said pad driver aperture and be delivered to the horizontal underfoot surface through said bottom center of said floor-operation pad.

10. The system of claim 9, wherein said configuration of said fluid-delivery hub in combination with said pad driver additionally is configured to elevate a central pad region of said floor-operation pad above said underfoot surface, thereby establishing a fluid pool region under the center of said separate and distinct floor-operation pad for pooling the fluid delivered to the horizontal underfoot surface through said bottom center of said pad driver.

11. The system of claim 9, further comprising:

said restraint attachment interface attached with a floor operation pad comprising: and operation pad aperture passing therethrough proximate a center thereof, and material features on an underside thereof for rotationally operating on the horizontal underfoot surface; wherein:

the configuration of said fluid-delivery hub in combination with said pad driver and further in combination with said floor-operation pad enables fluid emerging from said fluid exit openings proximate said bottom center of said fluid-delivery hub to pass through said pad driver aperture and through said operation pad aperture and be delivered to the horizontal underfoot surface through said bottom centers of said pad driver and said floor-operation pad.

12. The system of claim 11, wherein said configuration of said fluid-delivery hub in combination with said floor-operation pad and further in combination with said floor-operation pad additionally elevates a central pad region of said floor-operation pad above said underfoot surface, thereby establishing a fluid pool region under the center of said floor-operation pad for pooling the fluid delivered to the horizontal underfoot surface through said bottom centers of said pad driver and said floor-operation pad.

13. The system of claim 4, further comprising:

said fluid-delivery hub attached to a rotary-motion flooring machine, wherein when said rotary-motion flooring machine is operating said fluid-delivery hub rotates;

said ring fixing member of said fluid well ring is fixed to a fluid ring fixing restraint fixed to a non-rotating location on said rotary-motion flooring machine, wherein when said rotary-motion flooring machine is operating said fluid well ring does not rotate.

14. The system of claim 13, wherein when fluid is flowed into said fluid well ring via said fluid introduction port, the fluid flows through said fluid entry openings, through said fluid flow channels and out said fluid exit openings of said fluid-delivery hub, while said fluid-delivery hub is rotating.

15. The system of claim 13, further comprising a fluid source fluidically connected to said fluid introduction port via a fluid transit conduit, for flowing fluid between said fluid source and said fluid well ring via said fluid introduction port.

16. The system of claim 15, further comprising a fluid management system for managing at least one fluid parameter selected from the fluid parameter group consisting of: a flow rate of said fluid from said fluid source into said fluid introduction port; an applied positive flow pressure of said fluid from said fluid source into said fluid introduction port; an applied negative flow pressure of said fluid from said fluid source into said fluid introduction port; a quantity of fluid having flowed from said fluid source into said fluid introduction port; and a rate at which fluid flows from said fluid source into said fluid introduction port.

17. The system of claim 13, further comprising:

said floor-operation interface attached with a floor operation pad comprising: an operation pad aperture passing therethrough proximate a center thereof, and material features on an underside thereof for rotationally operating on the horizontal underfoot surface; wherein:

the configuration of said fluid-delivery hub in combination with said floor-operation pad enables fluid emerging from said fluid exit openings proximate said bottom center of said fluid-delivery hub to pass through said operation pad aperture and be delivered to the horizontal underfoot surface through said bottom center of said floor-operation pad.

18. The system of claim 13, further comprising:

a pad driver comprising a pad driver aperture passing therethrough proximate a center thereof, and a plurality of driver brushes for driving a separate and distinct floor-operation pad which floor-operation pads are attachable to and detachable from said pad driver interchangeably and at will;

said pad driver directly attached to said bottom of said fluid-delivery hub at said floor-operation interface; and said pad driver further comprising a restraint attachment interface configured wherein said floor-operation pads are enabled to be attachable to and detachable from said pad driver, at will; wherein:

the configuration of said fluid-delivery hub in combination with said pad driver enables fluid emerging from said fluid exit openings proximate said bottom center of said fluid-delivery hub to pass through said pad driver aperture and be delivered to the horizontal underfoot surface through said bottom center of said pad driver.

19. The system of claim 1, said fluid-delivery hub further comprising a fluid well running over an outside circumference of said fluid-delivery hub.

20. The system of claim 1, said fluid-delivery hub further comprising:

a pair of fluid-sealing rings running over an outside circumference of said fluid-delivery hub, said sealing rings defining and bounding a fluid well from above and from below;

said sealing rings configured to fit snugly inside an inside circumference of a fluid well ring; and said fluid-sealing rings further configured to permit relative rotation between said fluid-delivery hub and the fluid well ring.

21. A method for delivering fluid to and from a bottom center of a floor-operation pad on a rotary-motion flooring machine while the pad is rotationally operating on a horizontal underfoot surface, said method comprising:

providing a fluid-delivery hub comprising: a plurality of fluid entry openings disposed on an outside circumferential surface thereof; an equal plurality of fluid flow channels commencing at said fluid entry openings, angling downward and inward from said fluid entry openings toward a center of said fluid-delivery hub, and terminating at an equal plurality of fluid exit openings proximate a bottom center of said fluid-delivery hub; and a floor-operation interface at a bottom of said fluid-delivery hub for directly or indirectly attaching a floor-operation pad thereto, for operating on a floor;

providing a fluid well ring comprising: a ring body with an inside circumference thereof substantially the same as an outside circumference of said fluid-delivery hub proximate where said fluid entry openings are disposed; a fluid introduction port running thorough said ring body, commencing outside said ring body and terminating in a fluid well inside said ring body, for flowing fluid from outside said fluid well ring into said fluid well; and a ring fixing member attached to said ring body;

mounting said fluid well ring about said outside circumference of said fluid-delivery hub proximate where said fluid entry openings are disposed;

wherein responsive to said mounting, a pair of fluid-sealing rings define and bound and fluidically seal said fluid well between said outside circumference of said fluid-delivery hub and said inside circumference of said fluid well ring, from above and from below; said fluid-sealing rings fit snugly between said outside circumference of said fluid-delivery hub and said inside circumference of said ring body; and said fluid-sealing rings permit relative rotation between said fluid well ring and said fluid-delivery hub;

wherein further responsive to said mounting, said fluid well surrounds said fluid entry openings, while said fluid-sealing rings fluidically seal fluid in said fluid well against flowing between said fluid well ring and said fluid-delivery hub;

fixing said ring fixing member to a non-rotating location on the rotary-motion flooring machine, wherein said fluid well ring does not rotate while the rotary-motion flooring machine is causing said fluid-delivery hub to rotate.

22. The method of claim 21, further comprising flowing fluid into said fluid well ring via said fluid introduction port while said fluid-delivery hub is rotating, the fluid flowing through said fluid entry openings, through said fluid flow channels and out said fluid exit openings proximate said bottom center of said fluid-delivery hub.

23. The method of claim 21, further comprising permanently attaching said fluid-delivery hub to the rotary-motion flooring machine for causing said fluid-delivery hub to rotate when the rotary-motion flooring machine is operating.

24. The method of claim 21, further comprising attachably mating said fluid-delivery hub to the rotary-motion flooring machine at will, using a rotation-driving interface at a top region of said fluid-delivery hub which is also detachable from said rotary-motion flooring machine at will, for causing said fluid-delivery hub to rotate when the rotary-motion flooring machine is operating and when said fluid-delivery hub is attached to the rotary-motion flooring machine.

25. The method of claim 21, further comprising:

providing a locking ring comprising: a locking-ring body with an inside circumference thereof substantially the same as an outside circumference of said fluid-delivery hub proximate where said fluid entry openings are disposed; and a plurality of inward protrusions along said inside circumference of said locking-ring body:

configuring said fluid-delivery hub and said locking ring to mate with one another for securing said locking ring in a fixed position about and relative to said fluid-delivery hub; and securing said locking ring in said fixed position about and relative to said fluid-delivery hub, thereby substantially preventing vertical movement of said fluid well ring relative to said fluid-delivery hub, but still permitting said relative rotation between said fluid well ring and said fluid-delivery hub.

26. The method of claim 21, further comprising:

directly attaching at said floor-operation interface to said bottom of said fluid-delivery hub, a floor operation pad comprising: an operation pad aperture passing therethrough proximate a center thereof, and material features on an underside thereof for rotationally operating on the horizontal underfoot surface; and delivering fluid to the horizontal underfoot surface through said bottom center of said floor-operation pad by the fluid emerging from said fluid exit openings proximate said bottom center of said fluid-delivery hub further passing through said operation pad aperture of said floor-operation pad, using the configuration of said fluid-delivery hub in combination with said floor-operation pad.

27. The method of claim 26, further comprising elevating a central pad region of said floor-operation pad above said underfoot surface, thereby pooling the fluid delivered to the horizontal underfoot surface through said bottom center of said floor-operation pad into a fluid pool region under the center of said floor-operation pad, using said configuration of said fluid-delivery hub in combination with said floor-operation pad.

28. The method of claim 21, further comprising:

providing a pad driver comprising a pad driver aperture passing therethrough proximate a center thereof; a plurality of driver brushes for driving a separate and distinct floor-operation pad which floor-operation pads are attachable to and detachable from said pad driver interchangeably and at will; and a restraint attachment interface configured for attaching and detaching floor-operation pads thereto and therefrom, at will;

directly attaching said pad driver to said bottom of said fluid-delivery hub at said floor-operation interface; and passing fluid emerging from said fluid exit openings proximate said bottom center of said fluid-delivery hub through said pad driver aperture and delivering the fluid to the horizontal underfoot surface through said bottom center of said floor-operation pad, using the configuration of said fluid-delivery hub in combination with said pad driver.

29. The method of claim 28, further comprising elevating a central pad region of said floor-operation pad above said underfoot surface, thereby pooling the fluid delivered to the horizontal underfoot surface through said bottom center of said pad driver into a fluid pool region under the center of said separate and distinct floor-operation pad, using said configuration of said fluid-delivery hub in combination with said pad driver.

30. The method of claim 28, further comprising:

indirectly attaching to said bottom of said fluid-delivery hub via said pad driver using said restraint attachment interface of said pad driver, a floor-operation pad comprising: an operation pad aperture passing therethrough proximate a center thereof, and material features on an underside thereof for rotationally operating on the horizontal underfoot surface;

passing fluid emerging from said fluid exit openings proximate said bottom center of said fluid-delivery hub through said pad driver aperture and through said operation pad aperture and delivering the fluid to the horizontal underfoot surface through said bottom centers of said pad driver and said floor-operation pad, using the configuration of said fluid-delivery hub in combination with said pad driver and further in combination with said floor-operation pad.

31. The method of claim 30, further comprising elevating a central pad region of said floor-operation pad above said underfoot surface, thereby pooling the fluid delivered to the horizontal underfoot surface through said bottom centers of said pad driver and said floor-operation pad, using said configuration of said fluid-delivery hub in combination with said floor-operation pad and further in combination with said floor-operation pad.

32. The method of claim 21, further comprising:

rotating said fluid-delivery hub when said rotary-motion flooring machine is operating by attaching said fluid-delivery hub to a rotary-motion flooring machine;

not rotating said fluid well ring when said rotary-motion flooring machine is operating by fixing said ring fixing member of said fluid well ring to a fluid ring fixing restraint fixed to a non-rotating location on said rotary-motion flooring machine.

33. The method of claim 32, further comprising, while said fluid-delivery hub is rotating, flowing fluid into said fluid well ring via said fluid introduction port, through said fluid entry openings, through said fluid flow channels and out said fluid exit openings of said fluid-delivery hub.

34. The method of claim 32, further comprising, while said fluid-delivery hub is rotating, flowing fluid into said fluid exit openings of said fluid-delivery hub, through said fluid flow channels, out of said fluid entry openings, and out from said fluid well ring via said fluid introduction port.

35. The method of claim 32, further comprising flowing fluid between said fluid source and said fluid well ring via said fluid introduction port using a fluid source fluidically connected to said fluid introduction port via a fluid transit conduit.

36. The method of claim 35, further comprising a fluid management system for managing at least one fluid parameter selected from the fluid parameter group consisting of: a flow rate of said fluid from said fluid source into said fluid introduction port; an applied positive flow pressure of said fluid from said fluid source into said fluid introduction port; an applied negative flow pressure of said fluid from said fluid source into said fluid introduction port; a quantity of fluid having flowed from said fluid source into said fluid introduction port; and a rate at which fluid flows from said fluid source into said fluid introduction port.

37. The method of claim 32, further comprising:

directly attaching to said bottom of said fluid-delivery hub at said floor-operation interface, a floor-operation pad comprising: an operation pad aperture passing therethrough proximate a center thereof, and material features on an underside thereof for rotationally operating on the horizontal underfoot surface; and:

passing fluid emerging from said fluid exit openings proximate said bottom center of said fluid-delivery hub through said operation pad aperture and delivering the fluid to the horizontal underfoot surface through said bottom center of said floor-operation pad, using the configuration of said fluid-delivery hub in combination with said floor-operation pad.

38. The method of claim 32, further comprising:

providing a pad driver comprising: a pad driver aperture passing therethrough proximate a center thereof; a plurality of driver brushes for driving a separate and distinct floor-operation pad which floor-operation pads are attachable to and detachable from said pad driver interchangeably and at will; and a restraint attachment interface configured for attaching and detaching said floor-operation pads to and from said pad driver, at will;

directly attaching said pad driver to said bottom of said fluid-delivery hub at said floor-operation interface; and passing fluid emerging from said fluid exit openings proximate said bottom center of said fluid-delivery hub through said pad driver aperture and delivering the fluid to the horizontal underfoot surface through said bottom center of said pad driver using the configuration of said fluid-delivery hub in combination with said pad driver.

39. The method of claim 21, further comprising said fluid well running over an outside circumference of said fluid-delivery hub.

40. The method of claim 21, further comprising:

said pair of fluid-sealing rings running over said outside circumference of said fluid-delivery hub, said sealing rings defining and bounding a fluid well from above and from below;

said fitting snugly inside said inside circumference of said fluid well ring; and said fluid-sealing rings further permitting relative rotation between said fluid-delivery hub and said fluid well ring.

* * * * *